US008550581B2

(12) United States Patent
Ueda et al.

(10) Patent No.: US 8,550,581 B2
(45) Date of Patent: Oct. 8, 2013

(54) CONTROL DEVICE FOR CONTROLLING PRINTING EXECUTION UNIT

(75) Inventors: Masashi Ueda, Nagoya (JP); Hirotoshi Maehira, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 459 days.

(21) Appl. No.: 12/985,327

(22) Filed: Jan. 5, 2011

(65) Prior Publication Data

US 2011/0164079 A1 Jul. 7, 2011

(30) Foreign Application Priority Data

Jan. 6, 2010 (JP) ..... 2010-001067

(51) Int. Cl.
*B41J 29/38* (2006.01)

(52) U.S. Cl.
USPC ..... 347/9

(58) Field of Classification Search
USPC ..... 347/9
See application file for complete search history.

(56) References Cited

U.S. PATENT DOCUMENTS

2002/0070991 A1* 6/2002 Otsuki ..... 347/16

FOREIGN PATENT DOCUMENTS

JP 2002-103584 A 4/2002
JP 2004-034722 A 2/2004

* cited by examiner

*Primary Examiner* — Uyen Chau N Le
*Assistant Examiner* — Hoang Tran
(74) *Attorney, Agent, or Firm* — Baker Botts L.L.P.

(57) ABSTRACT

In the control device, the generating portion generates control data to be used by the controlling portion to form a specific image. The generating portion generates the control data such that in a first case where the printing execution unit forms the end image, the head drive portion drives the print head to eject ink droplet only from nozzles classified into the downstream nozzle group toward the downstream end region, that in a second case where the printing execution unit forms the center image the head drive portion drives the print head to eject ink droplet from the plurality of nozzles including the upstream and downstream nozzle groups toward the center region, and that, in the first case, the first nozzle does not eject ink droplet toward the center region for forming a specific part, and such that in the second case, the second nozzle ejects ink droplet for forming the specific part.

12 Claims, 10 Drawing Sheets

CONCEIVABLE EXAMPLE

CONTROL DEVICE FOR CONTROLLING PRINTING EXECUTION UNIT

CROSS REFERENCE TO RELATED APPLICATION

This application claims priority from Japanese Patent Application No. 2010-001067 filed Jan. 6, 2010. The entire content of the priority application is incorporated herein by reference.

TECHNICAL FIELD

The invention relates to a control device for controlling a printing execution unit to execute a printing operation.

BACKGROUND

Japanese patent application publication No. 2004-034722 discloses a printer that prints an image on a printing medium based on image data. This printer includes a platen having a contact part for contacting and supporting the printing medium as the printing medium is conveyed in a sub scanning direction. A groove part that does not contact the recording medium is also formed in the platen on the downstream side of the contact part relative to the sub scanning direction. The printer includes a print head for forming images on the recording media by ejecting ink droplets from a plurality of nozzles formed in the print head. These nozzles include a first nozzle group that opposes the contact part of the platen and a second nozzle group that opposes the groove part of the platen as the print head is conveyed in a main scanning direction.

With the printer described in Japanese patent application publication No. 2004-034722, ink droplets are ejected from both the first and second nozzle groups when printing a center image portion of the image in the center region of the recording medium with respect to the sub scanning direction. However, ink droplets are ejected only from the second nozzle group when forming edge image parts (constituting edges of an image) in either upstream or downstream edge regions of the recording medium with respect to the sub scanning direction. With this configuration, if the recording medium is not present at the position opposite the second nozzle group when ink droplets are ejected from the second nozzle group to print the edge image part due to error in conveying the recording medium, these ejected ink droplets will be deposited in the groove part of the platen rather than on the contact part. Accordingly, a recording medium that subsequently contacts the contact part will not be soiled by ink since ink droplets are not deposited on the contact part of the platen.

SUMMARY

It is an object of the invention to provide a control device for controlling a printing execution unit to print images of a high quality on a recording medium.

In order to attain the above and other objects, the invention provides a control device for controlling a printing execution unit. The printing execution unit includes a sheet conveying portion, a print head, a head conveying portion, a head drive portion, a sheet support portion, and a controlling portion. The sheet conveying portion is configured to convey a recording sheet from upstream side to downstream side in a first direction. The recording sheet includes a downstream end region in the first direction and a center region in the first direction. The print head has a plurality of nozzles arranged in the first direction. The plurality of nozzles includes an upstream nozzle group disposed at the upstream side in the first direction and a downstream nozzle group disposed at the downstream side in the first direction, the plurality of nozzles including a first nozzle classified into the upstream nozzle group and a second nozzle classified into the downstream nozzle. The head conveying portion is configured to convey the print head in a second direction. The head drive portion is configured to drive the print head to eject ink droplets from the plurality of nozzles. The sheet support portion includes a contact part contacting and supporting the recording sheet. When the head conveying portion conveys the print head in the second direction, the upstream nozzle group confronts the contact part and the downstream nozzle group does not confront the contact part. The controlling portion is configured to control the head conveying portion, the head drive portion, and the sheet conveying portion to execute a printing operation. The control device includes a generating portion and a supplying portion. The generating portion generates control data that is to be used by the controlling portion to form a specific image expressed by image data on the recording sheet in the printing operation. The specific image includes an end image located on an end portion of the specific image and a center image located on a center portion of the specific image. The supplying portion supplies the control data to the controlling portion. The generating portion generates the control data such that in a first case of the printing operation where the printing execution unit forms the end image on the downstream end region of the recording sheet, the sheet conveying portion conveys the recording sheet by a first conveying distance in the first direction and the head drive portion drives the print head to eject ink droplet only from nozzles classified into the downstream nozzle group toward the downstream end region. The generating portion generates the control data such that in a second case of the printing operation where the printing execution unit forms the center image on the center region of the recording sheet, the sheet conveying portion conveys the recording sheet by a second conveying distance greater than the first conveying distance in the first direction and the head drive portion drives the print head to eject ink droplet from the plurality of nozzles including the upstream nozzle group and the downstream nozzle group toward the center region. The generating portion generates the control data such that, in the first case, the first nozzle classified into the upstream nozzle group does not eject ink droplet toward the center region for forming a specific part in the center portion of the specific image, regardless of whether the first nozzle is capable of ejecting ink droplet toward the center region for forming the specific part, and such that in the second case, the second nozzle classified into the downstream nozzle group ejects ink droplet for forming the specific part that has not been formed by the first nozzle. According to another aspect, the invention provides a printer including the above described the control device and the printing execution unit.

According to another aspect, the invention provides a control device for controlling a printing execution unit. The printing execution unit includes a sheet conveying portion, a print head, a head conveying portion, a head drive portion, a sheet support portion, and a controlling portion. The sheet conveying portion is configured to convey a recording sheet from upstream side to downstream side in the first direction, the recording sheet includes an upstream end region in the first direction and a center region in the first direction. The print head has a plurality of nozzles arranged in a first direction. The plurality of nozzles includes an upstream nozzle group disposed at the upstream side in the first direction and a downstream nozzle group disposed at the downstream side in the first direction. The plurality of nozzles includes a first nozzle classified into the upstream nozzle group and a second nozzle classified into the downstream nozzle group. The head conveying portion is configured to convey the print head in a second direction. The head drive portion is configured to drive the print head to eject ink droplets from the plurality of nozzles. The sheet support portion includes a contact part contacting and supporting the recording sheet. When the head conveying portion conveys the print head in the second direction, the upstream nozzle group confronts the contact part and the downstream nozzle group does not confront the contact part. The controlling portion is configured to control the head conveying portion, the head drive portion, and the sheet conveying portion to execute a printing operation. The control device includes a generating portion and a supplying portion. The generating portion generates control data that is to be used by the controlling portion to form a specific image expressed by image data on the recording sheet in the printing operation. The specific image includes an end image located on an end portion of the specific image and a center image located on a center portion of the specific image. The supplying portion supplies the control data to the controlling portion. The generating portion generates the control data such that in a third case of the printing operation where the printing execution unit forms the center image on the center region of the recording sheet, the sheet conveying portion conveys the recording sheet by a third conveying distance in the first direction and the head drive portion drives the print head to eject ink droplet from the plurality of nozzles including the upstream nozzle group and the downstream nozzle group toward the center region. The generating portion generates the control data such that in a fourth case of the printing operation where the printing execution unit forms the end image on the upstream end region of the recording sheet, the sheet conveying portion conveys the recording sheet by a fourth conveying distance shorter than the third conveying distance in the first direction and the head drive portion drives the print head to eject ink droplet only from nozzles classified into the downstream nozzle group toward the upstream end region. The generating portion generates the control data such that, in the third case, the first nozzle classified into the upstream nozzle group does not eject ink droplet toward the center region for forming a specific part in the center portion of the specific image, regardless of whether the first nozzle is capable of ejecting ink droplet toward the center region for forming the specific part, and such that in the fourth case, the second nozzle classified into the downstream nozzle group ejects ink droplet for forming the specific part that has not formed by the first nozzle. According to another aspect, the invention provides a printer including the above described the control device and the printing execution unit.

BRIEF DESCRIPTION OF THE DRAWINGS

The particular features and advantages of the invention as well as other objects will become apparent from the following description taken in connection with the accompanying drawings, in which.

DETAILED DESCRIPTION

Structure of a Printing System

Figure 1:
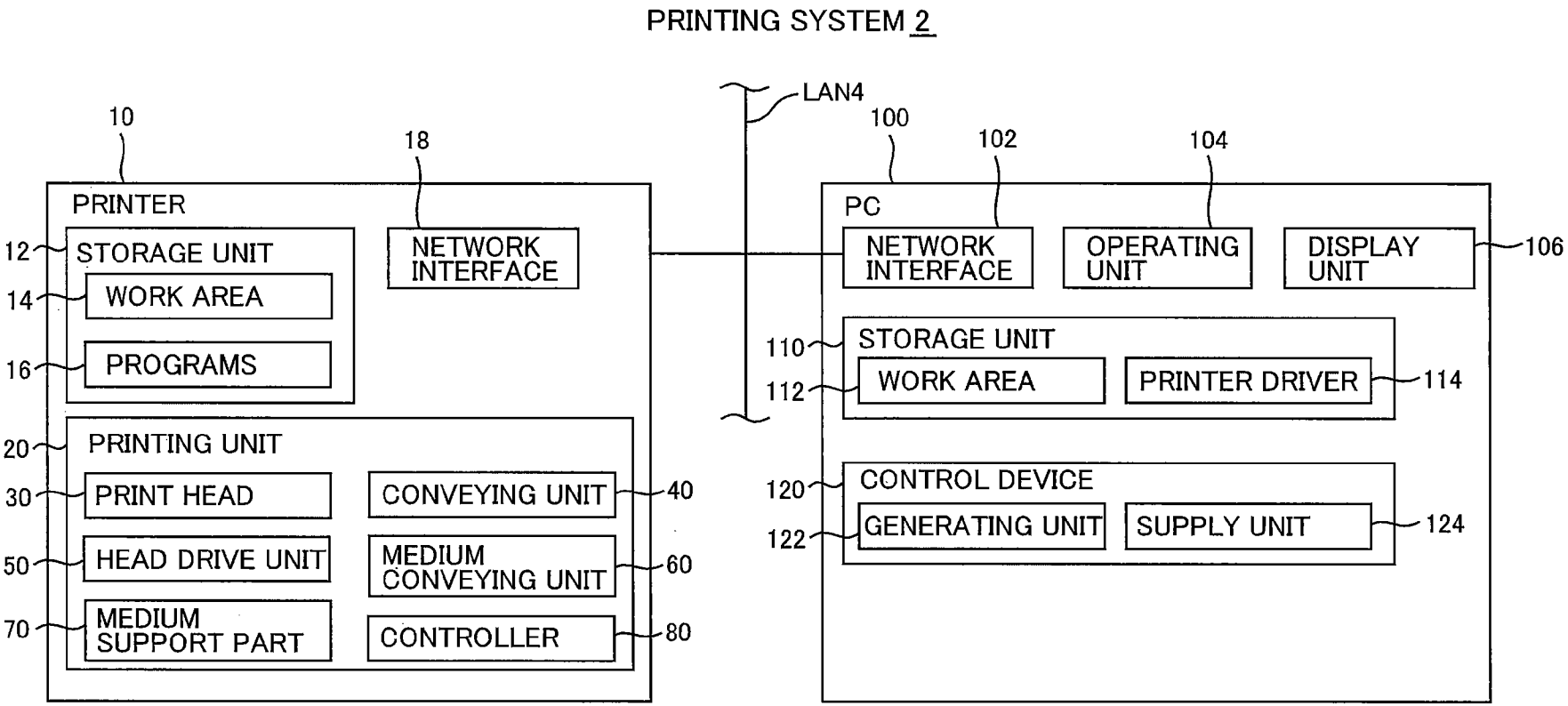
FIG. 1 is an explanation diagram illustrating a configuration of a printing system according to an embodiment.

Next, an overall structure of a printing system 2 according to an embodiment of the invention will be described. As shown in FIG. 1, the printing system 2 includes a local area network (LAN) 4, a printer 10, and a personal computer (PC) 100. The printer 10 and PC 100 are connected to the LAN 4 and can communicate with each other via the LAN 4.

Structure of the Printer

The printer 10 includes a storage unit 12, a network interface 18, and a printing unit 20. The storage unit 12 has a work area 14 for storing various data produced when a controller 80 described later executes various processes. The storage unit 12 also stores various programs 16 executed by the controller 80 described later.

The printing unit 20 has a print head 30, a head conveying unit 40, a head drive unit 50, a medium conveying unit 60, a medium support part 70, and the controller 80. The structure of the components 30 through 80 constituting the printing unit 20 will be described in greater detail with reference to FIGS. 2 and 3.

Figure 2:
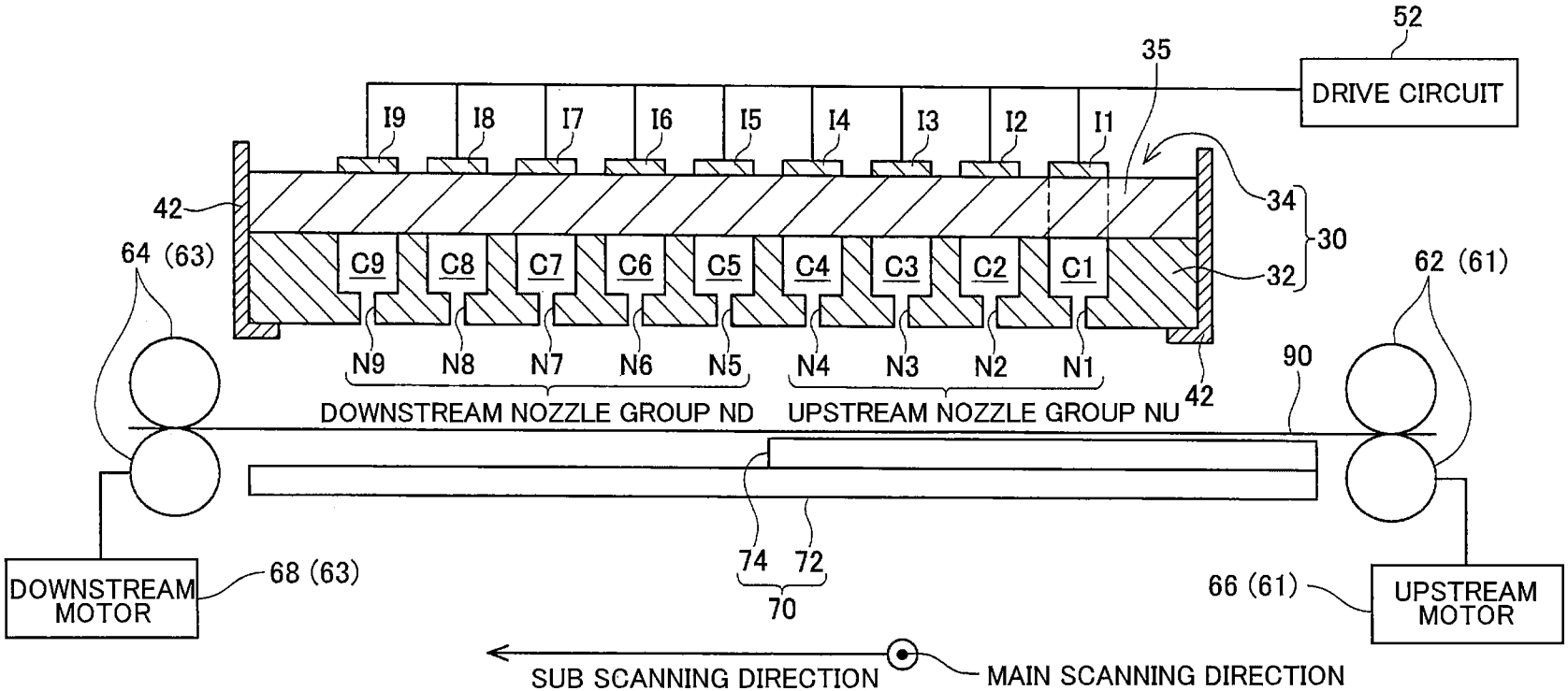
FIG. 2 is an explanation diagram illustrating a part of a printing unit according to the embodiment.

As shown in FIG. 2, the print head 30 includes an ink channel unit 32 and an actuator unit 34. A plurality (nine in the embodiment) of nozzles N1-N9 is formed in the bottom surface of the ink channel unit 32 for ejecting ink droplets. As will be described later in greater detail, a printing medium 90 is conveyed leftward in FIG. 2. The conveying direction of the printing medium 90 (i.e., leftward in FIG. 2) will be called the "sub scanning direction." The nozzles N1-N9 are formed at regular intervals in the sub scanning direction (that is, the nozzles N1-N9 are aligned in the sub scanning direction and spaced at regular intervals). While the nozzles N1-N9 are arranged linearly along the sub scanning direction in the embodiment, the nozzles could be arranged nonlinearly in a variation of the embodiment. A plurality (nine in the embodiment) of pressure chambers C1-C9 is formed in the ink channel unit 32. The pressure chambers C1-C9 are filled with ink of a prescribed color (black, for example). Each of the nozzles N1-N9 is in fluid communication with a single and discrete pressure chamber (one of chambers C1-C9).

The actuator unit 34 is bonded to the top surface of the ink channel unit 32. The actuator unit 34 includes a laminate 35, and a plurality (nine in the embodiment) of individual electrodes I1-I9. The laminate 35 is formed by laminating a plurality of piezoelectric sheets and a common electrode sheet.

Each of the piezoelectric sheets and the common electrode sheet is configured of one sheet that extends across all of the pressure chambers C1-C9. Each of the individual electrodes I1-I9 is disposed on the top surface of the laminate 35 and are arranged at positions having a discrete correspondence with one of the pressure chambers C1-C9. When a drive circuit 52 described later supplies a drive signal to an individual electrode constituting the actuator unit 34 (the individual electrode I1, for example), the portion of the laminate 35 opposite this individual electrode (in this example, the portion of the laminate 35 within the two dotted lines in FIG. 2) deforms, changing the pressure within the pressure chamber positioned opposite this portion of the laminate 35 (pressure chamber C1 in this example). This change in pressure causes an ink droplet to be ejected from the nozzle that is in communication with this pressure chamber (the nozzle N1 in this example).

Figure 3:
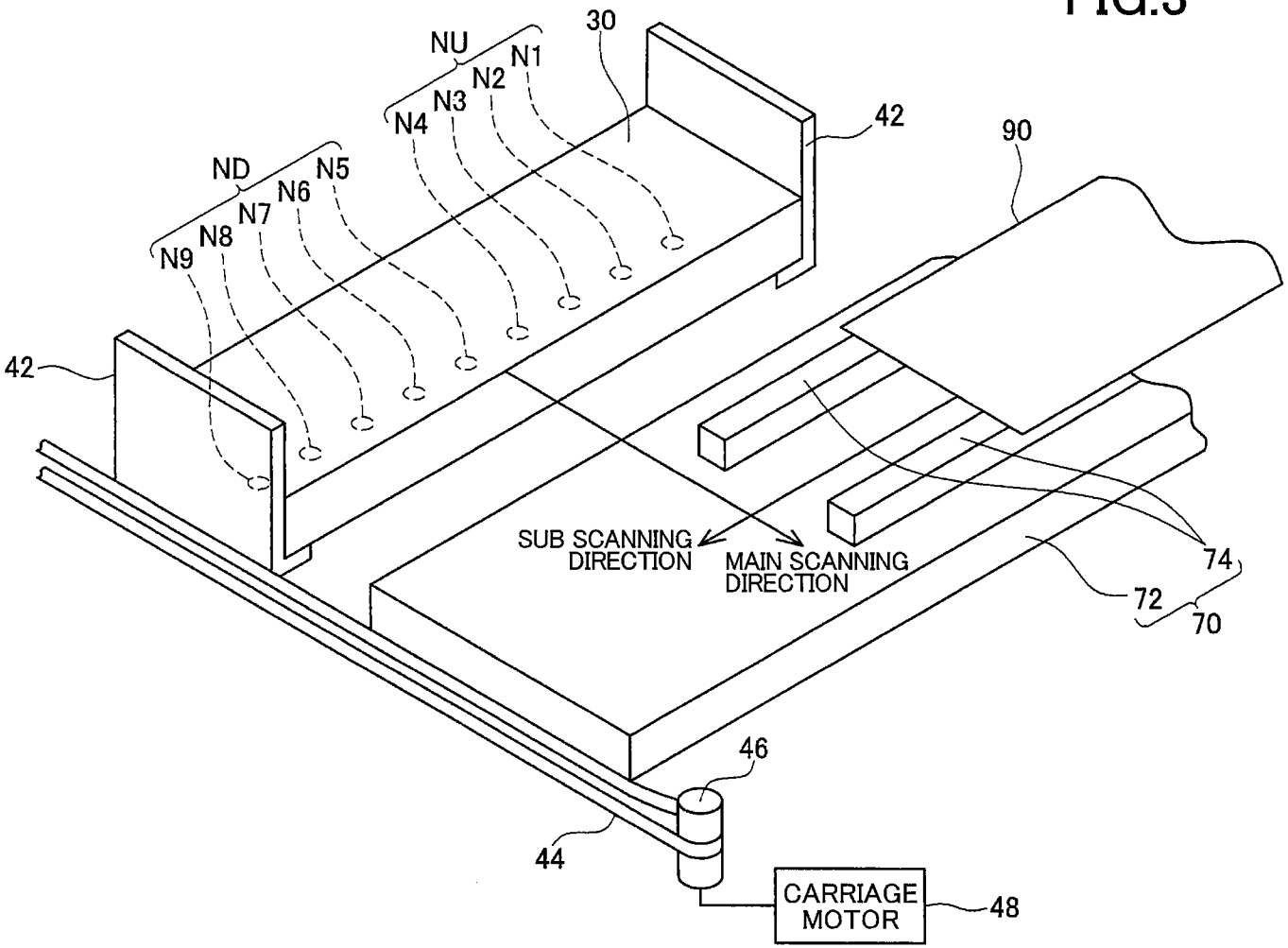
FIG. 3 is a perspective view of a part of the printing unit.

As shown in FIG. 3, the head conveying unit 40 (see FIG. 1) includes a carriage 42, a belt 44, a pair of pulleys 46 (only one of the pulleys 46 is shown in FIG. 3), and a carriage motor 48. The carriage 42 supports the print head 30 such that the print head 30 is removably mounted on the carriage 42. The belt 44 is an endless belt that is engaged with the carriage 42 and looped around the pair of pulleys 46. The carriage motor 48 is connected to one of the pulleys 46. When the carriage motor 48 is driven, the pulley 46 connected to the carriage motor 48 rotates, causing the belt 44 looped around the pulleys 46 to circulate. Consequently, the carriage 42 connected to the belt 44 and the print head 30 supported in the carriage 42 move together with the circulating motion of the belt 44. The carriage 42 is reciprocated by selectively rotating the pulley 46 in forward and reverse directions. The reciprocating direction of the carriage 42 and, hence, the reciprocating direction of the print head 30 is referred to as the "main scanning direction." The main scanning direction is orthogonal to the sub scanning direction and is the direction orthogonal to the surface of the drawing for FIG. 2. In the embodiment, one reciprocating movement of the print head 30 is referred to as "one main scan." In the course of one main scan in which the pulley 46 is driven in both forward and reverse directions, ink droplets are ejected from the nozzles N1-N9 formed in the print head 30 during an "outgoing pass" (when the pulley 46 is driven forward) but not during a "return pass" (when the pulley 46 is driven in reverse). However, in a variation of the embodiment, ink droplets may be ejected from the nozzles N1-N9 during both the outgoing pass and the return pass of the print head 30 in a single reciprocation. In this case, each of the outgoing pass and the return pass of the print head 30 during one reciprocation may be referred to as one main scan.

As shown in FIG. 2, the head drive unit 50 (see FIG. 1) includes a drive circuit 52. The drive circuit 52 is connected to each of the individual electrodes I1-I9 and supplies drive signals thereto. These drive signals drive the print head 30 to eject ink droplets from the nozzles N1-N9.

As shown in FIG. 2, the medium conveying unit 60 (see FIG. 1) includes an upstream conveying unit 61 and a downstream conveying unit 63. The upstream conveying unit 61 includes a pair of upstream rollers 62 disposed upstream of the print head 30 in the sub scanning direction (leftward in FIG. 2), and an upstream motor 66 connected to one of the upstream rollers 62. The downstream conveying unit 63 includes a pair of downstream rollers 64 disposed downstream of the print head 30 in the sub scanning direction, and a downstream motor 68 connected to one of the downstream rollers 64.

The upstream rollers 62 and the downstream rollers 64 rotate when the respective upstream motor 66 and the downstream motor 68 are driven. When a printing medium 90 is fed from a paper tray (not shown) to the upstream rollers 62, the printing medium 90 is conveyed by the upstream rollers 62 alone in the sub scanning direction. Once the printing medium 90 reaches the downstream rollers 64, the printing medium 90 is subsequently conveyed in the sub scanning direction by both the upstream rollers 62 and the downstream rollers 64. After the trailing edge of the printing medium 90 separates from the upstream rollers 62, the printing medium 90 is conveyed by the downstream rollers 64 alone in the sub scanning direction and is subsequently discharged onto a discharge tray (not shown).

As the printing medium 90 passes beneath the print head 30, ink droplets are ejected from the nozzles N1-N9 formed in the print head 30 to print an image on the printing medium 90. The operation to print an image on the printing medium 90 begins before the printing medium 90 arrives at the downstream rollers 64. Consequently, the downstream end of the printing medium 90 in the sub scanning direction (the left end in FIG. 2) is printed while the printing medium 90 is supported by the upstream rollers 62 but not by the downstream rollers 64. The printing medium 90 continues to be printed after arriving at the downstream rollers 64 and even after the trailing edge separates from the upstream rollers 62. Accordingly, the upstream end of the printing medium 90 in the sub scanning direction (right end in FIG. 2) is printed while the printing medium 90 is supported by the downstream rollers 64 but not by the upstream rollers 62.

As shown in FIG. 2, the medium support part 70 (see FIG. 1) is disposed below the print head 30 and between the upstream rollers 62 and the downstream rollers 64. The medium support part 70 opposes the print head 30 while the print head 30 reciprocates in the main scanning direction. As shown in FIG. 2, the medium support part 70 includes a base part 72, and a plurality of protruding parts 74. The base part 72 is substantially plate-shaped extending in the main and sub scanning directions. As shown in FIG. 3, a plurality (two in the embodiment) of the protruding parts 74 protrudes upward from the top surface of the base part 72. The base part 72 and the protruding parts 74 may be formed as an integral unit or as separate components. Each of the protruding parts 74 contacts and supports the printing medium 90 conveyed downstream by the upstream rollers 62. The printing medium 90 does not contact the base part 72. An ink absorber (not shown) is provided on the top surface of the base part 72. Each of the protruding parts 74 is elongated in the sub scanning direction. As can be seen in FIG. 2, the protruding parts 74 are arranged such that their upstream ends in the sub scanning direction (the right ends in FIG. 2) are farther upstream (farther rightward in FIG. 2) than the nozzle N1. More specifically, the upstream ends of the protruding parts 74 relative to the sub scanning direction are positioned farther upstream than the upstream end of the print head 30. Accordingly, each protruding part 74 includes a portion that does not oppose the print head 30 (i.e., a portion not confronting the nozzles among N1-N9) as the print head 30 reciprocates in the main scanning direction. Further, the protruding parts 74 are formed such that their downstream ends relative to the sub scanning direction (the left ends in FIG. 2) are positioned between the nozzles N4 and N5 of the print head 30. Accordingly, while the print head 30 reciprocates in the main scanning direction, the four nozzles N1-N4 positioned on the upstream side confront the protruding parts 74, while the five nozzles N5-N9 positioned on the downstream side do not confront the protruding parts 74. Hereinafter, the four nozzles N1-N4 opposing the protruding parts 74 will be referred to collectively as the "upstream nozzle group NU" and the five nozzles N5-N9 not opposing the protruding parts 74 will be referred to collectively as the "downstream nozzle group ND."

The controller 80 (see FIG. 1) executes various processes based on the programs 16 stored in the storage unit 12. The controller 80 uses control data described later supplied from the PC 100 to control the carriage motor 48 of the head conveying unit 40 (see FIG. 3), the drive circuit 52 of the head drive unit 50 (see FIG. 2), and the motors 66 and 68 of the medium conveying unit 60 (see FIG. 2).

Structure of the PC

As shown in FIG. 1, the PC 100 includes a network interface 102, an operating unit 104, a display unit 106, a storage unit 110, and a control device 120. The network interface 102 is connected to the LAN 4. The operating unit 104 is configured of a mouse and keyboard. By operating the operating unit 104, the user can input various instructions into the PC 100. The display unit 106 serves to display various data.

The storage unit 110 is provided with a work area 112 for storing print data, for example. This print data may be generated by an application (word processing program, for example) running on the PC 100 or may be acquired from an external device (a network server or a portable storage device), for example. The work area 112 also stores various data generated when the control device 120 described later executes processes. The storage unit 110 also stores a printer driver 114 for controlling the printer 10. The printer driver 114 is a software program used to transmit various instructions (print commands, for example) to the printer 10. The printer driver 114 may be installed in the PC 100 from computer-readable media or from a network server, for example.

The control device 120 executes various processes based on programs (the printer driver 114, for example) stored in the storage unit 110. By executing processes based on the printer driver 114, the control device 120 can implement functions of a generating unit 122 and a supply unit 124. The generating unit 122 generates control data for use by the controller 80 of the printer 10. The supply unit 124 supplies control data generated by the generating unit 122 to the controller 80.

Processes Executed by the PC

Next, processes executed by the control device 120 of the PC 100 will be described. The user of the PC 100 can perform operations on the operating unit 104 to select desired data and to print images represented by that data. The operations on the operating unit 104 include selecting a desired printing resolution. In this example, it will be assumed that the user has selected image data in the RGB bitmap format (hereinafter referred to as "RGB image data"). The control device 120 may convert the user-selected data to RGB image data according to a method well known in the art if the user selects data in a different format (for example, text data, image data in a bitmap format other than RGB, or a combination of text and bitmap data). After the user performs operations to select and print image data, the control device 120 executes the process described in the flowchart of FIG. 4 according to the printer driver 114. The RGB data is stored in the storage unit 110, for example.

Figure 4:
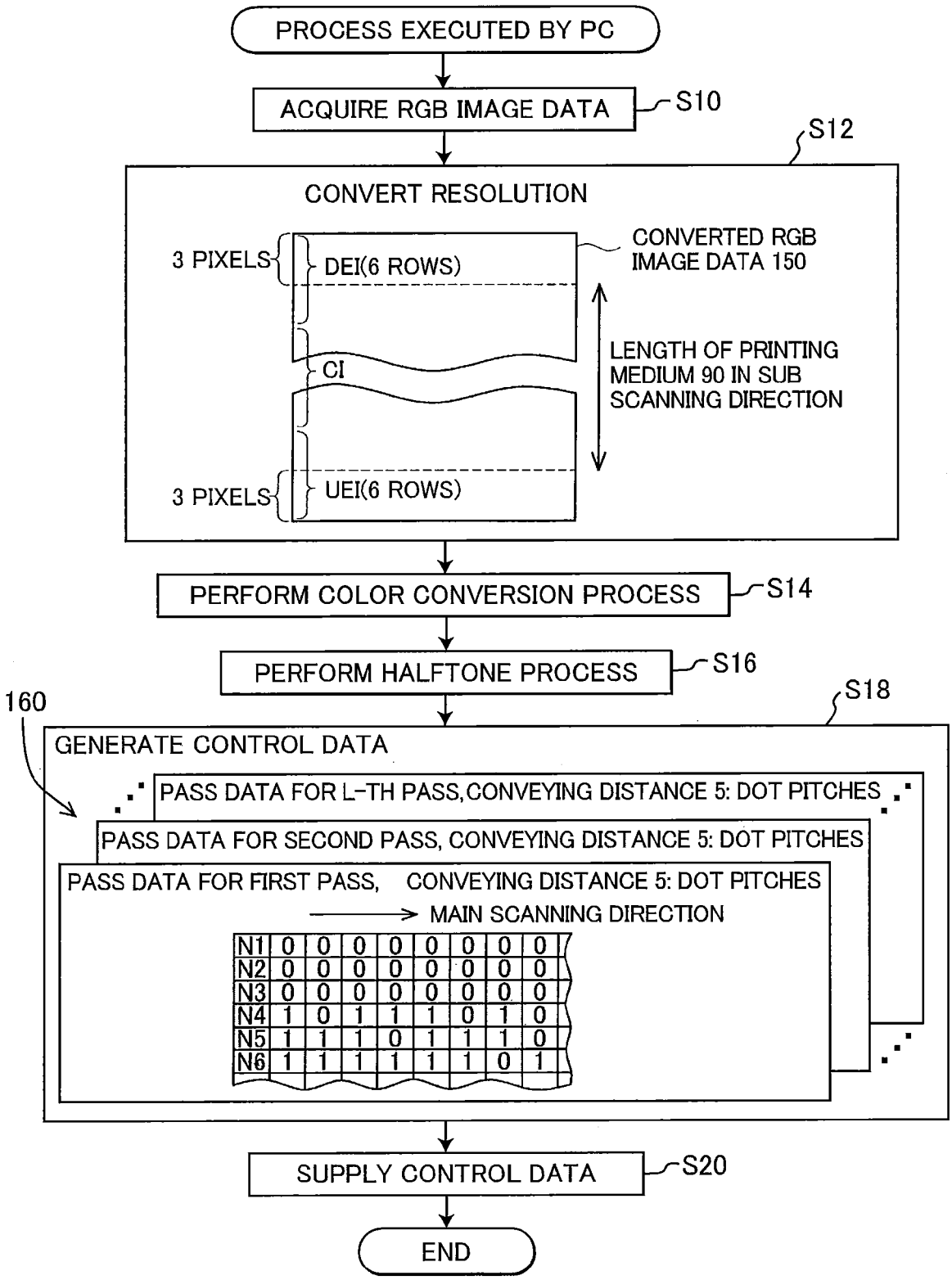
FIG. 4 is a flowchart illustrating a process executed by a PC according to the embodiment.

In S10 of FIG. 4, the generating unit 122 of the control device 120 (see FIG. 1) acquires RGB image data from the storage unit 110, for example. In S12 the generating unit 122 performs a process on the RGB image data acquired in S10 to convert the resolution according to a well-known technique and generates converted RGB image data 150. That is, in S12 the generating unit 122 converts the RGB image data to a resolution corresponding to the user-selected printing resolution. The converted RGB image data 150 includes a plurality of pixels in a plurality of rows and columns. As shown in S12 of FIG. 4, one row comprises a plurality of pixels arranged in the left-to-right direction of the diagram, while one column is configured of a plurality of pixels arranged vertically in the diagram. Each pixel comprises R, G, and B values and each of the R, G, and B values is multi-value data indicating a level from among 256 levels (0-255). In the embodiment, the direction in which rows of the converted RGB image data 150 are juxtaposed (vertical direction shown in S12 of FIG. 4) corresponds to the sub scanning direction of the printing medium 90, and the direction in which the columns of the converted RGB image data 150 are juxtaposed (left-to-right direction shown in S12 of FIG. 4) corresponds to a direction orthogonal to the sub scanning direction of the printing medium 90, i.e., the main scanning direction. In other words, when an image is printed on the printing medium 90 based on the converted RGB image data 150, the vertical dimension of the data shown in S12 is rendered along the sub scanning direction, while the left-to-right dimension of the data shown in S12 is rendered along the main scanning direction. Moreover, in the embodiment the upper side of the image rendered by the converted RGB image data 150 shown in S12 corresponds to the downstream side in the sub scanning direction, while the lower side of the image shown in S12 corresponds to the upstream side in the sub scanning direction. Hence, the upper portion of the image expressed by the converted RGB image data 150 shown in S12 (indicated by reference letters DEI) is printed on the downstream edge of the printing medium 90 in the sub scanning direction, and the lower portion of the image shown in S12 (indicated by reference letters UEI) is printed on the upstream edge of the printing medium 90 in the sub scanning direction.

In S12 the generating unit 122 generates the converted RGB image data 150 to render an image that is larger than a size corresponding to the actual length of the printing medium 90 in the sub scanning direction. Specifically, if P designates the total number of rows in the converted RGB image data 150, then the number of rows corresponding to the length of the printing medium 90 in the sub scanning direction is P−6. Hence, if the center of the image expressed by the converted RGB image data 150 relative to the sub scanning direction is aligned with the center of the printing medium 90 in the sub scanning direction, then the converted RGB image data 150 includes pixels for three rows beyond the downstream edge of the printing medium 90 in the sub scanning direction (the top edge in FIG. 4) and pixels for three rows beyond the upstream edge of the printing medium 90 in the sub scanning direction (the bottom edge in FIG. 4). Hence, in this example, it is not possible to print the entire length of the image expressed by the converted RGB image data 150 in the sub scanning direction within the length of the printing medium 90 in the sub scanning direction. However, as will be described later in greater detail, the use of the converted RGB image data 150 described above makes it possible to print an image on the printing medium 90 without margins (white space) on the upstream and downstream edges of the printing medium 90 relative to the sub scanning direction.

The image represented by the converted RGB image data 150 includes a downstream end image DEI, an upstream end image UEI, and a center image CI formed between the end images DEI and UEI. The downstream end image DEI is an image rendered by a group of pixels belonging to rows 1-6. The upstream end image UEI is an image rendered by a group of pixels belonging to rows (P−5) through P (where P is the total number of rows in the converted RGB image data 150). Therefore, the center image CI is an image rendered by the group of pixels belonging to rows 7 through (P−6). The end images DEI and UEI are respectively printed on the downstream edge region and the upstream edge region of the printing medium 90 relative to the sub scanning direction. The center image CI is printed in the central region of the printing medium 90 relative to the sub scanning direction. As will be described later in greater detail, the operations of the printing unit 20 for printing the end images DEI and UEI on the printing medium 90 differ from the operations for printing the center image CI on the printing medium 90.

In S14 of FIG. 4, the generating unit 122 performs a color conversion process on the converted RGB image data 150 using a well-known technique. In this process, the generating unit 122 converts the converted RGB image data 150 to image data in the CMYK bitmap format (hereinafter referred to as "CMYK image data"). The generating unit 122 produces one pixel described in the CMYK format for each pixel in the converted RGB image data 150. In other words, the number of pixels in the CMYK image data is equivalent to the number of pixels in the converted RGB image data 150. Hence, the image expressed by the CMYK image data includes an image area corresponding to the downstream end image DEI, an image area corresponding to the upstream end image UEI, and an image area corresponding to the center image CI. Each pixel in the CMYK image data comprises C, M, Y, and K values, and each of these CMYK values is multi-value data indicating a level from among 256 levels (0-255).

In S16 the generating unit 122 executes a halftone process on the CMYK image data using a technique well known in the art, such as an error diffusion or dither process. In this process, the generating unit 122 converts the CMYK image data to binary image data in a bitmap format with "1" values to indicate that dots are ON and "0" values to indicate that dots are OFF (hereinafter referred to as "binary data"). The generating unit 122 produces one pixel described as a binary value from each pixel in the CMYK image data. In other words, the number of pixels in the binary data is equivalent to the number of pixels in the CMYK image data. Hence, the image expressed by the binary data includes an image area corresponding to the downstream end image DEI, an image area corresponding to the upstream end image UEI, and an image area corresponding to the center image CI. In the embodiment, the printer 10 forms dots on the printing medium 90 by ejecting ink droplets in the color black (K) from the nozzles N1-N9. Therefore, each pixel in the binary data indicates either K=1 or K=0. However, if the print head 30 has groups of nozzles corresponding to the colors C, M, and Y, for example, in addition to the nozzles N1-N9, then each pixel in the binary data includes values corresponding to the colors C, M, and Y as well as a value corresponding to K. Further, while the generating unit 122 generates binary data indicating a dot is ON or OFF in the embodiment, the generating unit 122 may instead generate data of three values or greater. For example, the generating unit 122 may generate four-value data indicating one of the values: large dot ON (3), medium dot ON (2), small dot ON (1), and dot OFF (0).

In S18 of FIG. 4, the generating unit 122 generates control data 160 using the binary data. The control data 160 includes data for a plurality of passes (a plurality of sets of pass data), where "pass" signifies a main scan of the print head 30. One pass is equivalent to one main scan. Data for each pass includes a conveying distance indicating the distance for conveying the printing medium 90 in the sub scanning direction. In the example shown in S18 of FIG. 4, pass data for the $1^{st}$ pass includes a distance of five dot pitches. Here "one dot pitch" is equivalent to the distance between two adjacent dots in the sub scanning direction when printing based on binary data. Data for each pass also includes information about a plurality of pixels corresponding to each of the nozzles N1-N9. Information about each pixel in the pass data corresponds to information about a pixel in the binary data and is either a "0" or a "1", where a "0" indicates that a dot is not formed (i.e., an ink droplet is not ejected) and a "1" indicates that a dot is formed (i.e., an ink droplet is ejected). In the example shown in FIG. 4, the plurality of pixels associated with the nozzle N4 in the data for the $1^{st}$ pass indicate the values "1", "0", "1", . . . in order from left to right. This data signifies that, as the print head 30 moves in the outgoing direction of the $1^{st}$ pass (main scan), the drive circuit 52 controls ink droplet ejection from the nozzle N4 in the sequence "ejection," "non-ejection," "ejection," . . . . The method of generating the control data 160 will be described later in greater detail after first describing the printing process implemented according to the control data 160.

In S20 of FIG. 4, the supply unit 124 (see FIG. 1) supplies the control data 160 to the printer 10. When the printer 10 receives the control data 160, the controller 80 of the control device 120 controls the head conveying unit 40, the head drive unit 50, and the medium conveying unit 60 to perform a printing operation based on the control data 160. Next, the details of the printing operation executed by the printing unit 20 based on the control data 160 will be described.

Printing Operation

Figure 5:
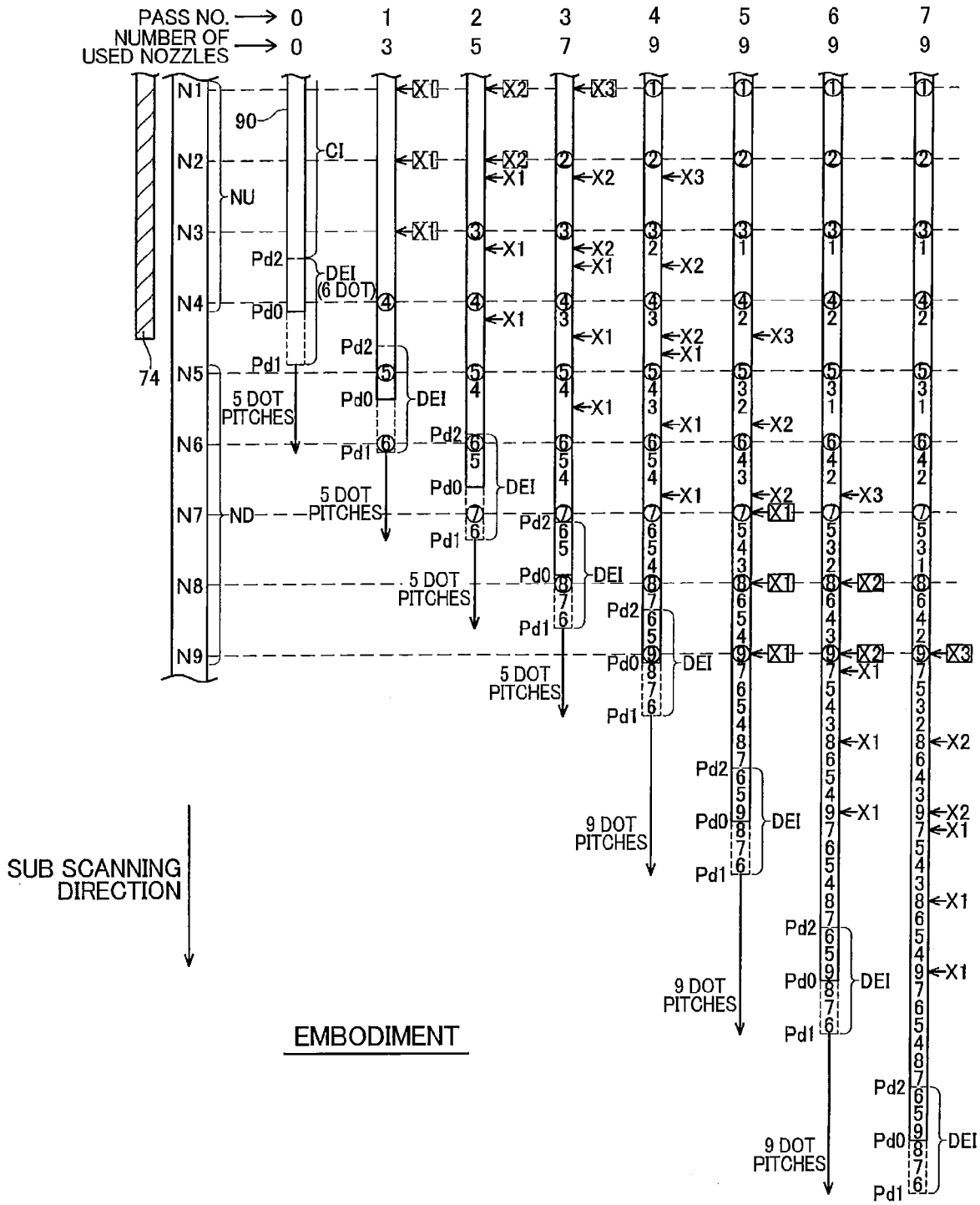
FIG. 5 is an explanation diagram illustrating how a downstream edge of a recording medium is printed according to the embodiment.

FIG. 5 illustrates the printing process for scanning $0^{th}$ to $7^{th}$ passes of the print head 30. The reference numerals N1-N9 in FIG. 5 represent the nozzles N1-N9. In the areas of FIG. 5 corresponding to each pass, the printing medium 90 has been represented by a strip-like rectangle for convenience. In the following description, "downstream in the sub scanning direction" and "upstream in the sub scanning direction" will be abbreviated as "downstream" and "upstream." The printing resolution in the sub scanning direction in the embodiment is set to a resolution for forming four dots within one nozzle pitch. As described earlier, one nozzle pitch is the distance between two adjacent nozzles in the sub scanning direction (e.g., the distance between the nozzles N1 and N2). Thus, the printer 10 according to the embodiment performs four passes (main scans) to form four dots within a single nozzle pitch. This method of printing can be called "four-pass interlace printing."

$0^{th}$ Pass

As shown in the area of FIG. 5 corresponding to the $0^{th}$ pass (pass no. "0"), the controller 80 performs a trial process for attempting to convey the downstream edge of the printing medium 90 to a prescribed position Pd0 by controlling the upstream motor 66 of the medium conveying unit 60 (see FIG. 2). As a result, the printing medium 90 is conveyed in the sub scanning direction while part of the printing medium 90 is supported on the protruding parts 74 of the medium support part 70 (see FIG. 3). When the above trial process succeeds in stopping the downstream edge of the printing medium 90 at Pd0, this conveying operation will be called an "ideal conveyance." When an ideal conveyance is performed, a region of the printing medium 90 corresponding to a width of one dot pitch from the downstream edge is aligned with the position of the nozzle N4 in the sub scanning direction.

While it is desirable to achieve an ideal conveyance in every printing operation, an ideal conveyance is not always possible due to mechanical error in the upstream motor 66, for example. In some trial processes, the downstream edge of the printing medium 90 may stop at a position beyond the position Pd0, for example. Such a conveying result will be called a "conveyance with positive error" in the following description. In the area of FIG. 5 corresponding to the $0^{th}$ pass, reference number Pd1 indicates the maximum conveying position for a conveyance with positive error at which printing can be performed without producing white space on the downstream edge of the printing medium 90. The distance between Pd0 and Pd1 is three dot pitches. In the following description, a conveying operation performed through the above trial process that results in the downstream edge of the printing medium 90 stopping at the Pd1 will be called a "conveyance with maximum positive error."

In other trial processes, the downstream edge of the printing medium 90 may not reach the position Pd0. In the following description, this conveying result will be called a "conveyance with negative error." In the area of FIG. 5 corresponding to the $0^{th}$ pass, a reference number Pd2 indicates the maximum conveying position for conveyance with negative error at which printing can be performed without depositing ink droplets on the protruding parts 74 (see FIG. 3). The distance between Pd0 and Pd2 is three dot pitches. In the following description, a conveying operation performed during the above trial process that results in the downstream edge of the printing medium 90 stopping at Pd2 will be called a "conveyance with maximum negative error."

As can be seen from the above description, the allowable margin of error for printing without producing white space on the downstream edge of the printing medium 90 and without depositing ink droplets on the protruding parts 74 is ±three dot pitches in the embodiment. Generally speaking, the number of rows corresponding to the downstream end image DEI of the image expressed by the converted RGB image data 150 (six rows in the example of S12 in FIG. 4) matches the allowable margin of error (six dot pitches). As will be described later in greater detail, the allowable margin of error for printing without producing white space on the downstream edge of the printing medium 90 and without depositing ink droplets on the protruding parts 74 is also ±three dot pitches when printing an image corresponding to the upstream end image UEI on the printing medium 90. Generally speaking, the number of rows corresponding to the upstream end image UEI (six rows in the example of S12 in FIG. 4) matches the allowable margin of error (six dot pitches).

$1^{st}$ Pass

Next, the controller 80 controls the upstream motor 66 of the medium conveying unit 60 to convey the printing medium 90 five dot pitches, as indicated in the area of FIG. 5 corresponding to the $0^{th}$ pass, based on the data for the $1^{st}$ pass (see S18 of FIG. 4). As a result, the printing medium 90 is conveyed to the position shown in the area of FIG. 5 corresponding to the $1^{st}$ pass. Pd0 in the area corresponding to the $1^{st}$ pass indicates the position at which the downstream edge of the printing medium 90 stops after the above ideal conveyance was achieved and the printing medium 90 was further conveyed five dot pitches. However, when the trial process did not result in an ideal conveyance but a conveyance with positive or negative error, this error is preserved. Pd1 and Pd2 in the area corresponding to the $1^{st}$ pass indicate the positions at which the downstream edge of the printing medium 90 stops when being conveyed five dot pitches after the trial process resulted in a conveyance with the maximum positive error and the maximum negative error, respectively. The positions Pd0, Pd1, and Pd2 have the same significance in the remaining areas of FIG. 5 corresponding to the $2^{nd}$ through $7^{th}$ passes.

Next, the controller 80 controls the carriage motor 48 of the head conveying unit 40 (see FIG. 3) to move the print head 30 for performing a main scan. While the print head 30 is moving in the outgoing direction of the main scan, the controller 80 controls the drive circuit 52 of the head drive unit 50 to eject ink droplets from the nozzles at positions corresponding to pixels that are designated with a "1" in the pass data for the $1^{st}$ pass. In the example shown in S18 of FIG. 4, the head drive unit 50 drives three nozzles N4, N5, and N6 to eject ink droplets in the $1^{st}$ pass to form a cluster of dots on the printing medium 90. The encircled numbers 4, 5, and 6 on the printing medium 90 corresponding to the $1^{st}$ pass in FIG. 5 indicate the dot cluster formed by the nozzles N4, N5, and N6. Numbers on the printing medium 90 in other areas of FIG. 5 corresponding to the $2^{nd}$ and subsequent passes also indicate dots formed by the nozzles corresponding to these numbers. Encircled numbers in FIG. 5 designate dots formed in the current pass, while numbers that are not encircled designate dots formed in previous passes.

In the $1^{st}$ pass, the head drive unit 50 drives the nozzle N6 to eject ink droplets that correspond to the pixel group of the $1^{st}$ row image in the binary data (i.e., the $1^{st}$ row in the converted RGB image data 150) and to eject ink droplets from the nozzle N5 corresponding to the pixel group of the $5^{th}$ row image in the binary data. That is, the nozzles N5 and N6 eject ink droplets for printing the downstream end image DEI (the image represented by a group of pixels belonging to the $1^{st}$ through $6^{th}$ rows). Also in the $1^{st}$ pass, the head drive unit 50 drives the nozzle N4 to eject ink droplets that correspond to the group of pixels of the $9^{th}$ row image in the binary data. Hence, the nozzle N4 ejects ink droplets for printing the center image CI (the image represented by the group of pixels belonging to the $7^{th}$ through $(P-6)^{th}$ rows).

In the $1^{st}$ pass, the three nozzles N1-N3 can eject ink droplets for printing the center image CI. However, the head drive unit 50 does not drive the nozzles N1-N3 to eject ink droplets, that is, the head drive 50 does not drive the nozzles N1-N3 to eject ink droplets, in order to prevent an abrupt change in the number of nozzles ejecting ink droplets between two consecutive passes. This will be described later in greater detail. Arrows X1 in the area of FIG. 5 corresponding to the $1^{St}$ pass indicate the positions on the printing medium 90 of dots that are not formed in the $1^{st}$ pass, regardless of whether the nozzles N1-N3 can eject ink droplets to form dots. Hereinafter, nozzles that do not form dots in the $1^{st}$ through $3^{rd}$ passes (nozzles N1-N3 in the $1^{st}$ pass), regardless of whether the nozzles are capable of forming dots, will be called the "first special nozzles."

As one example, if the conveying operation in the trial process resulted in a conveyance with maximum positive error, the downstream edge of the printing medium 90 stops at Pd1 in the $1^{st}$ pass. In this case, the printing medium 90 is present at the position corresponding to the nozzle N6 in the sub scanning direction. Hence, ink droplets ejected from any of the nozzles N4-N6 will impact the printing medium 90. On the other hand, if an ideal conveyance was achieved during the trial process, the printing medium 90 is not present at the position of the nozzle N6 in the sub scanning direction during the $1^{st}$ pass, but the nozzle N6 still ejects ink droplets for printing the downstream end image DEI. The nozzle N6 belongs to the downstream nozzle group ND and, hence, does not oppose the protruding parts 74 while the print head 30 is performing a main scan. Accordingly, ink droplets ejected from the nozzle N6 are not deposited on the protruding parts 74. Alternatively, if the conveyance with maximum negative error occurred during the trial process, the printing medium 90 is not present at the positions of the nozzles N5 and N6 in the sub scanning direction during the $1^{st}$ pass, but the nozzles N5 and N6 eject ink droplets for printing the downstream end image DEI. Since the nozzles N5 and N6 both belong to the downstream nozzle group ND, ink droplets ejected from the nozzles N5 and N6 will not become deposited on the protruding parts 74. It is also possible in the $2^{nd}$ through $4^{th}$ passes that the nozzles N6-N9 will eject ink droplets for printing the downstream end image DEI, despite the printing medium 90 not being present. Since the nozzles N6-N9 all belong to the downstream nozzle group ND, ink droplets ejected from these nozzles are not deposited on the protruding parts 74. In other words, ink droplets are ejected only from the downstream nozzle group ND to print the downstream end image DEI and are not ejected from the upstream nozzle group NU, so that ink droplets are not deposited on the protruding parts 74.

$2^{nd}$ Through $4^{th}$ Passes

Next, the controller 80 controls the head conveying unit 40, the head drive unit 50, and the medium conveying unit 60 based on the sequence of pass data for the $2^{nd}$ through $4^{th}$ passes, whereby the following series of processes is repeatedly executed to print the $2^{nd}$ through $4^{th}$ passes: (1) the medium conveying unit 60 conveys the printing medium 90 five dot pitches, (2) the head conveying unit 40 conveys the print head 30 in a main scan, and (3) the head drive unit 50 drives the nozzles to ejects ink droplets.

In the $2^{nd}$ pass, the head drive unit 50 drives the five nozzles N3-N7 to eject ink droplets. Of these, ink droplets ejected from the nozzles N6 and N7 are designed to print the downstream end image DEI. More specifically, the head drive unit 50 drives the nozzle N7 to eject ink droplets corresponding to the pixel group belonging to the $2^{nd}$ row image in the binary data. Further, the head drive unit 50 drives the nozzle N6 to eject ink droplets corresponding to the pixel group of the $6^{th}$ row image. The ink droplets ejected from the nozzles N3-N5 in the $2^{nd}$ pass are used to print the center image CI. Here, the head drive unit 50 does not drives the nozzles N1 and N2 to eject ink droplets, that is, the head drive unit 50 does not drive the nozzles N1 and N2 to eject ink droplets in the $2^{nd}$ pass, regardless of whether the nozzles N1 and N2 can eject ink droplets for printing the center image CI. The arrows X2 in the area of FIG. 5 corresponding to the $2^{nd}$ pass indicate positions on the printing medium 90 at which dots are not formed in the $2^{nd}$ pass, regardless of whether the nozzles N1 and N2 (i.e., the first special nozzles N1 and N2) can eject ink droplets to form dots.

In the $3^{rd}$ pass, the head drive unit 50 drives the seven nozzles N2-N8 to eject ink droplets, whereby ink droplets for printing the downstream end image DEI (ink droplets corresponding to the group of pixels of the $3^{rd}$ row image in the binary data) are ejected from the nozzle N8, and ink droplets for printing the center image CI are ejected from the nozzles N2-N7. In the $3^{rd}$ pass, the head drive unit 50 does not drive the nozzle N1 to eject ink droplets, that is, the head drive unit 50 does not drive the nozzle N1 to eject ink droplets, regardless of whether the nozzle N1 can eject ink droplets for printing the center image CI. The arrow X3 added to the area of FIG. 5 corresponding to the $3^{rd}$ pass indicates a position on the printing medium 90 at which dots are not formed in the $3^{rd}$ pass, regardless of whether the nozzle N1 (i.e., the first special nozzle N1) can eject ink droplets to form dots.

As should be clear from the above description, the first special nozzles in each of the $1^{St}$ through $3^{rd}$ passes are at least one of the nozzles N1-N3 belonging to the upstream nozzle group NU. Specifically, the first special nozzles in the $1^{st}$ through $3^{rd}$ passes do not include nozzle N4 disposed farthest downstream in the upstream nozzle group NU, but include only at least one of the nozzles N1-N3 disposed relatively upstream in the upstream nozzle group NU. Particularly, the first special nozzles in each of the $1^{st}$ through $3^{rd}$ passes include the nozzle N1, which is disposed farthest upstream among the nozzles N1-N9.

In the $4^{th}$ pass, the head drive unit 50 drives the all nine nozzles N1-N9 to eject ink droplets, whereby ink droplets for printing the downstream end image DEI (ink droplets corresponding to the pixel group of the $4^{th}$ row image in the binary data) are ejected from the nozzle N9. As is clear from the area of FIG. 5 corresponding to the $4^{th}$ pass, the ejection of ink droplets from the downstream end nozzle N9 in the $4^{th}$ pass completes the process to print the entire downstream end image DEI. In other words, the downstream end nozzle N9 is the nozzle that ejects the final ink droplets for forming the downstream end image DEI. In the $4^{th}$ pass, the nozzles N1-N8 eject ink droplets for printing the center image CI from nozzles N1-N8.

As described above, the conveying distance included in the pass data for the $1^{st}$ through $4^{th}$ passes indicates five dot pitches. The conveying distance included in pass data for the $(L-3)^{th}$ through $L^{th}$ passes described later (see FIG. 7) also indicates five dot pitches. Generally speaking, when the number of nozzles in the downstream nozzle group ND is n, the downstream end image DEI and the upstream end image UEI can be printed by ejecting ink droplets with only the n nozzles in the downstream nozzle group ND, while conveying the printing medium 90 a conveying distance of n dot pitches. Further, when one nozzle pitch is equivalent to k dot pitches (where k is an integer of 1 or greater; in the embodiment, k is "4"), generally speaking k and n are relatively prime.

As should be clear from the above description, the printing unit 20 ejects ink droplets for printing the downstream end image DEI only from the downstream nozzle group ND in the $1^{st}$ through $4^{th}$ passes. When conveyance with maximum positive error occurred during the trial process, the entire downstream end image DEI (i.e., the image corresponding to $1^{st}$ through $6^{th}$ lines in the binary data) is formed in a six-dot-pitch region on the printing medium 90 between the Pd1 and Pd2. In the following description, the region on the printing medium 90 in which the downstream end image DEI is formed will be called the "downstream end region." Therefore, when a conveyance with the maximum positive error occurs, the downstream end region is a six-dot-pitch region from the downstream edge of the printing medium 90. Further, when the ideal conveyance was achieved in the trial process, part of the downstream end image DEI (i.e., an image corresponding to three lines worth of the binary image data, and specifically the $4^{th}$ through $6^{th}$ lines) is formed in a three-dot-pitch region between the Pd0 and Pd2. Hence, in this case, the downstream end region is a three-dot-pitch region from the downstream edge of the printing medium 90. When conveyance with maximum negative error occurs, the downstream end image DEI is not formed on the printing medium 90. In other words, in this case, the downstream end region does not exist.

$5^{th}$ Through $7^{th}$ Passes

Next, the controller 80 controls the head conveying unit 40, the head drive unit 50, and the medium conveying unit 60 based on the pass data for the $5^{th}$ through $7^{th}$ passes in sequence. The conveying distance included in the pass data for each of the $5^{th}$ through $7^{th}$ passes specifies nine dot pitches, which is greater than the five dot pitches specified as the conveying distance in pass data for the $1^{St}$ through $4^{th}$ passes. Therefore, the medium conveying unit 60 conveys the printing medium 90 nine dot pitches. In the $5^{th}$ through $7^{th}$ passes, the head drive unit 50 drives the nine nozzles N1-N9 to eject ink droplets to print the center image CI. In the $5^{th}$ through $7^{th}$ passes (and in the $8^{th}$ through $(L-5)^{th}$ passes described later), the head drive unit 50 does not drive the nozzles N1-N9 to eject ink droplets for printing the downstream end image DEI and the upstream end image UEI, that is the head drive unit 50 does not drive the nozzles N1-N9 to eject ink droplets for printing the downstream end image DEI and the upstream end image UEI.

In the $5^{th}$ pass, the head drive unit 50 drives the three nozzles N7-N9 to eject ink droplets for forming dots at positions indicated by the positions indicated three arrows X1s. In other words, the nozzles N7-N9 form dots at the positions X1, where dots were not formed by the first special nozzles N1-N3. In the following description, nozzles used to form dots in the $5^{th}$ through $7^{th}$ passes at positions where dots were not formed by the first special nozzles in the $1^{st}$ through $3^{rd}$ passes will be called the "second special nozzles." So, in the $5^{th}$ pass, the three nozzles N7-N9 are the second special nozzles. In the $6^{th}$ pass, the head drive unit 50 drives the second special nozzles N8 and N9 to eject ink droplets for forming dots at positions X2 where dots were not formed by the first special nozzles N1 and N2 in the $2^{nd}$ pass. In the $7^{th}$ pass, the head drive unit 50 drives the second special nozzle N9 to eject ink droplets for forming dots at the position X3 where dots were not formed by the first special nozzle N1 in the $3^{rd}$ pass.

As should be clear from the above description, the second special nozzles used in the $5^{th}$ through $7^{th}$ passes are at least one of the nozzles N7-N9 that belong to the downstream nozzle group ND. More specifically, the second special nozzles used in the $5^{th}$ through $7^{th}$ passes do not include the nozzle N5 disposed farthest upstream among the nozzles in the downstream nozzle group ND, but include the nozzles N7-N9 disposed relatively downstream in the downstream nozzle group ND. The second special nozzles used in the $5^{th}$ through $7^{th}$ passes particularly include the nozzle N9 disposed farthest downstream.

As described above, the conveying distance included in pass data for each of the $5^{th}$ through $7^{th}$ passes specifies nine dot pitches. The conveying distance included in pass data for each of the $8^{th}$ through $(L-4)^{th}$ passes (see FIG. 7) also indicates nine dot pitches. Generally speaking, when the number of nozzles for printing image is m (where m is an integer of 1 or greater, in the embodiment m is "9"), the center image CI can be printed by ejecting ink droplets with the m nozzles, while conveying the printing medium 90 a conveying distance of m dot pitches. Further, when one nozzle pitch is equivalent to k dot pitches (where k is an integer of 1 or greater; in the embodiment, k is "4"), generally speaking k and m are relatively prime.

$8^{th}$ Through $(L-8)^{th}$ Passes

Next, the controller 80 controls the head conveying unit 40, the head drive unit 50, and the medium conveying unit 60 based on pass data for the $8^{th}$ through $(L-8)^{th}$ passes in sequence. Through this control process, the medium conveying unit 60 conveys the printing medium 90 nine dot pitches, and the head drive unit 50 drives all the nine nozzles N1-N9 to eject ink droplets for printing the center image CI.

$(L-7)^{th}$ Through $(L-5)^{th}$ Passes

Figure 7:
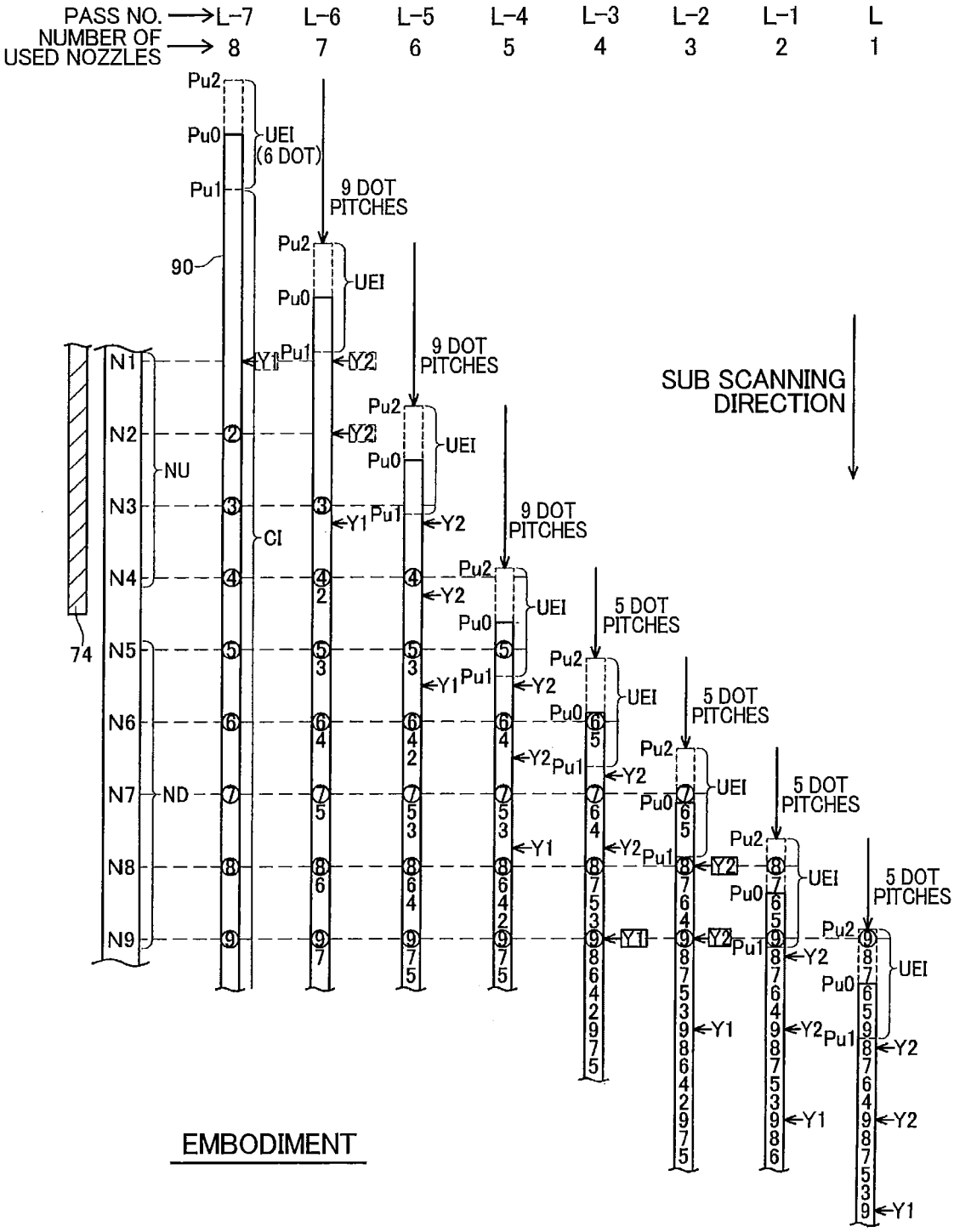
FIG. 7 is an explanation diagram illustrating how an upstream edge of a recording medium is printed according to the embodiment.

FIG. 7 shows the printing operations for the $(L-7)^{th}$ through $L^{th}$ passes. In FIG. 7 dot clusters formed prior to the $(L-8)^{th}$ pass have been omitted. The controller 80 controls the head conveying unit 40, the head drive unit 50, and the medium conveying unit 60 based on pass data for the $(L-7)^{th}$ through $(L-5)^{th}$ passes in sequence. For each of the $(L-7)^{th}$ through $(L-5)^{th}$ passes, the medium conveying unit 60 conveys the printing medium 90 nine dot pitches. The position Pu0 in the area of FIG. 7 corresponding to the $(L-7)^{th}$ pass indicates the position at which the upstream edge of the printing medium 90 stops in the $(L-7)^{th}$ pass when the trial process described earlier resulted in an ideal conveyance. Positions Pu1 and Pu2 in the area of FIG. 7 corresponding to the $(L-7)^{th}$ pass indicate positions at which the upstream edge of the printing medium 90 stops in the $(L-7)^{th}$ pass when the trial process resulted in a conveyance with maximum positive error and a conveyance with maximum negative error, respectively. Positions Pu0, Pu1, and Pu2 indicate similar positions in areas of FIG. 7 corresponding to the $(L-6)^{th}$ through $L^{th}$ passes. In the $(L-7)^{th}$, $(L-6)^{th}$, and $(L-5)^{th}$ passes, the head drive unit 50 drives respectively the eight nozzles (N2-N9), the seven nozzles (N3-N9), and the six nozzles (N4-N9) to eject ink droplets for printing the center image CI.

In the $(L-7)^{th}$ pass, the head drive unit 50 does not drive the nozzle N1 to eject ink droplets, regardless of whether nozzle N1 is capable of ejecting ink droplets for printing the center image CI. In the following description, the nozzles that do not form dots in the $(L-7)^{th}$ and $(L-6)^{th}$ passes (the nozzle N1 in the $(L-7)^{th}$ pass), regardless of whether the nozzles are capable of forming dots, will be called the "third special nozzles." The arrow Y1 in the area of FIG. 7 corresponding to the $(L-7)^{th}$ pass indicates the position on the printing medium 90 at which dots are not formed in the $(L-7)^{th}$ pass, regardless of whether the third special nozzle N1 is capable of ejecting ink droplets to form dots.

In the $(L-6)^{th}$ pass, the head drive unit 50 does not drive the nozzles N1 and N2 (i.e., the third special nozzles N1 and N2) to eject ink droplets, regardless of whether the nozzles N1 and N2 are capable of ejecting ink droplets for printing the center image CI. The arrow Y2 in the area of FIG. 7 corresponding to the $(L-6)^{th}$ pass indicates the position at which dots were not formed in the $(L-6)^{th}$ pass, regardless of whether the third special nozzles N1 and N2 were capable of ejecting ink droplets to form dots.

As should be clear from the above description, the third special nozzles in the $(L-7)^{th}$ and $(L-6)^{th}$ passes include at least one of the nozzles N1 and N2 belonging to the upstream nozzle group NU, does not includes the farthest downstream nozzle N4 among the upstream nozzle group NU, and disposed relatively upstream among the nozzles in the upstream nozzle group NU. In particular, the third special nozzles in both the $(L-7)^{th}$ and $(L-6)^{th}$ passes include the nozzle N1, which is disposed farthest upstream among the nozzles N1-N9.

In the $(L-5)^{th}$ pass, the head drive unit 50 does not drive the nozzles N2 and N3 to eject ink droplets, regardless of whether nozzles N2 and N3 are capable of ejecting ink droplets to print the upstream end image UEI. The reason for this configuration is as follows. When the trial process described earlier results in a conveyance with maximum positive error, the upstream edge of the printing medium 90 stops downstream of the nozzle N3 in the $(L-5)^{th}$ pass. Hence, the printing medium 90 does not exist at the positions of the nozzles N2 and N3 relative to the sub scanning direction. The nozzles N2 and N3 belong to the upstream nozzle group NU and thus oppose the protruding parts 74 while the print head 30 reciprocates. Accordingly, ink droplets ejected from the nozzles N2 and N3 at this time would become deposited on the protruding parts 74. Therefore, the head drive unit 50 does not drive the nozzles N2 and N3 to eject ink droplets in the $(L-5)^{th}$ pass to prevent ink droplets from becoming deposited on the protruding parts 74.

$(L-4)^{th}$ Through $L^{th}$ Passes

Next, the controller 80 controls the head conveying unit 40, the head drive unit 50, and the medium conveying unit 60 based on the pass data for the $(L-4)^{th}$ through $L^{th}$ passes in sequence. The conveying distance included in data for the $(L-4)^{th}$ pass indicates nine dot pitches, while the conveying distance included in the data for the $(L-3)^{th}$ through $L^{th}$ passes indicates five dot pitches. Hence, in the $(L-4)^{th}$, $(L-3)^{th}$, $(L-2)^{th}$, $(L-1)^{th}$, and $L^{th}$ passes, the head drive unit 50 drives respectively the five nozzles (N5-N9), the four nozzles (N6-N9), the three nozzles (N7-N9), the two nozzles (N8 and N9), and one nozzles (N9), to eject ink droplets.

In the $(L-4)^{th}$ pass, the head drive unit 50 drives the nozzle N5 to eject ink droplets for printing the upstream end image UEI (ink droplets corresponding to the pixel group of the $(P-4)^{th}$ row image in the binary data), and drives the nozzles N6-N9 to eject ink droplet for printing the center image CI. In order to prevent ink droplets from becoming deposited on the protruding parts 74 in the $(L-4)^{th}$ pass, the head drive unit 50 dose not drive the nozzle N4 to eject ink droplets, regardless of whether the nozzle N4 is capable of ejecting ink droplets for printing an image corresponding to the upstream end image UEI.

In the $(L-3)^{th}$ pass, the head drive unit 50 drives the nozzle N6 to eject ink droplets for printing the upstream end image UEI (ink droplets corresponding to the group of pixels of the $(P-3)^{th}$ row image in the binary data) and drives the nozzles N7-N9 to eject ink droplets for printing the center image CI. As a result, the nozzle N9 forms dots at the position Y1, where the third special nozzle N1 did not form dots in the $(L-7)^{th}$ pass. In the following description, the nozzles that form dots in the $(L-3)^{th}$ and $(L-2)^{th}$ passes at positions that the third special nozzles did not form dots in the $(L-7)^{th}$ and $(L-6)^{th}$ passes will be called the "fourth special nozzles." So, in the $(L-3)^{th}$ pass, the nozzle N9 is the fourth special nozzle.

In the $(L-2)^{th}$ pass, the head drive unit 50 drives the nozzle N7 to eject ink droplets for printing an image corresponding to the upstream end image UEI (ink droplets corresponding to the group of pixels in the $(P-2)^{th}$ row image of the binary data), and drives the nozzles N8 and N9 to eject ink droplets for printing an image corresponding to the center image CI. As a result, the nozzles N8 and N9 (i.e., the fourth special nozzles N8 and N9) form dots at the position Y2 where the third special nozzles N1 and N2 did not form dots in the $(L-6)^{th}$ pass.

As should be clear from the above description, the fourth special nozzles in the $(L-3)^{th}$ and $(L-2)^{th}$ passes include at least one of the nozzles N8 and N9 belonging to the downstream nozzle group ND, does not includes the farthest upstream nozzle N5 among the downstream nozzle group ND, and positioned relatively downstream among the nozzles in the downstream nozzle group ND. In particular, the fourth special nozzles in the $(L-3)^{th}$ and $(L-2)^{th}$ passes include the nozzle N9, which is positioned farthest downstream among all the nozzles N1-N9.

In the $(L-1)^{th}$ pass, the head drive unit 50 drives the nozzles N8 and N9 to eject ink droplets for printing the upstream end image UEI (ink droplets corresponding to the pixel group in the $(P-1)^{th}$ and $(P-5)^{th}$ rows image of the binary data). In the $L^{th}$ pass, the head drive unit 50 drives the nozzle N9 to eject ink droplets for printing the upstream end image UEI (ink droplets corresponding to the pixel group in the $P^{th}$ row of the binary data). As can be seen in the area of FIG. 7 corresponding to the $L^{th}$ pass, ink droplets for printing the entire upstream end image UEI have been ejected after ejecting ink droplets from the downstream end nozzle N9 in the $L^{th}$ pass. In other words, the downstream end nozzle N9 ejects the final ink droplets for completing the upstream end image UEI.

As described above, the printing unit 20 ejects ink droplets for printing the upstream end image UEI only from the downstream nozzle group ND in the $(L-4)^{th}$ through $L^{th}$ passes. When the trial process resulted in a conveyance with maximum negative error, the entire upstream end image UEI (i.e., the image corresponding to six rows of the binary data, and specifically rows (P−5) through P) is formed in a region of six dot pitches between points Pu1 and Pu2 on the printing medium 90. Hereinafter, the region of the printing medium 90 in which the upstream end image UEI is formed will be called the "upstream end region." Hence, when the trial process resulted in a conveyance with maximum negative error, the upstream end region is a region of six dot pitches from the upstream edge of the printing medium 90. When the trial process resulted in an ideal conveyance, part of the upstream end image UEI (specifically, the image corresponding to three rows of the binary data, and more particularly to rows (P−5) through (P−3)) is formed in a region of three dot pitches between the points Pu0 and Pu1 on the printing medium 90. Hence, in this case, the upstream end region is a three-dot-pitch region from the upstream edge of the printing medium 90. When the trial process resulted in a conveyance with maximum positive error, the upstream end image UEI is not formed on the printing medium 90. Hence, the upstream end region does not exist in this case.

Hereinafter, the region of the printing medium 90 on which the center image CI (the image corresponding to the $7^{th}$ through $(P-6)^{th}$ rows of the binary data) is formed will be called the "center region." The center region on the printing medium 90 is the area between points Pd2 (FIG. 5) and Pu1 (FIG. 7), whether the trial process resulted in an ideal conveyance, a conveyance with positive error, or a conveyance with negative error. Hence, the size of the center region on the printing medium 90 is fixed in the embodiment, regardless of the conveying state of the printing medium 90 (ideal conveyance, etc.), in order to form the entire center image CI on the printing medium 90.

Method of Generating Control Data

Next, the process performed in S18 of FIG. 4 will be described again in greater detail. In S18 the generating unit 122 generates control data to execute the above printing operations described with reference to FIGS. 5 and 7. As the conveying distance data, the generating unit 122 generates data indicating five dot pitches for each of the $1^{st}$ through $4^{th}$ passes and $(L-3)^{th}$ through $L^{th}$ passes and generates data indicating nine dot pitches for each of the $5^{th}$ through $(L-4)^{th}$ passes. When generating pass data, the generating unit 122 generates a plurality of pixels corresponding to each nozzle for forming dots in the corresponding pass, as indicated in FIGS. 5 and 7.

For example, in the $1^{st}$ pass shown in FIG. 5, the first special nozzles N1-N3 do not eject ink droplets, regardless of whether they are capable of ejecting ink droplets for printing the center image CI. Hence, the values for each pixel corresponding to the nozzles N1-N3 are set to "0", as indicated in the pass data shown in S18 of FIG. 4 for the $1^{st}$ pass. Further, in the $1^{st}$ pass, the nozzles N4, N5, and N6 form dots corresponding to pixels in the binary data belonging to the $9^{th}$ row, $5^{th}$ row, and $1^{st}$ row, respectively. Accordingly, when generating pass data for the $1^{st}$ pass, the generating unit 122 extracts values for each pixel in the $9^{th}$ row from the binary data and sets the values of pixels corresponding to the nozzle N4 to these extracted values. Similarly, the generating unit 122 sets the values of pixels corresponding to the nozzles N5 and N6 to values extracted from the binary data for pixels in the $5^{th}$ row and $1^{st}$ row, respectively.

Further, in the example of the $5^{th}$ pass shown in FIG. 5, the second special nozzles N7-N9 form dots at positions X1 for dots that were not formed by the first special nozzles N1-N3 in the $1^{St}$ pass. Therefore, when generating pass data for the $5^{th}$ pass, the generating unit 122 extracts values from the binary data for pixels belonging to rows corresponding to the positions X1 in the $5^{th}$ pass and sets the values of pixels corresponding to the nozzles N7-N9 to the extracted pixel values. Using a similar technique, the generating unit 122 sets the values of pixels corresponding to each nozzle in data for L passes comprising the $1^{st}$ through $L^{th}$ passes.

Figure 9:
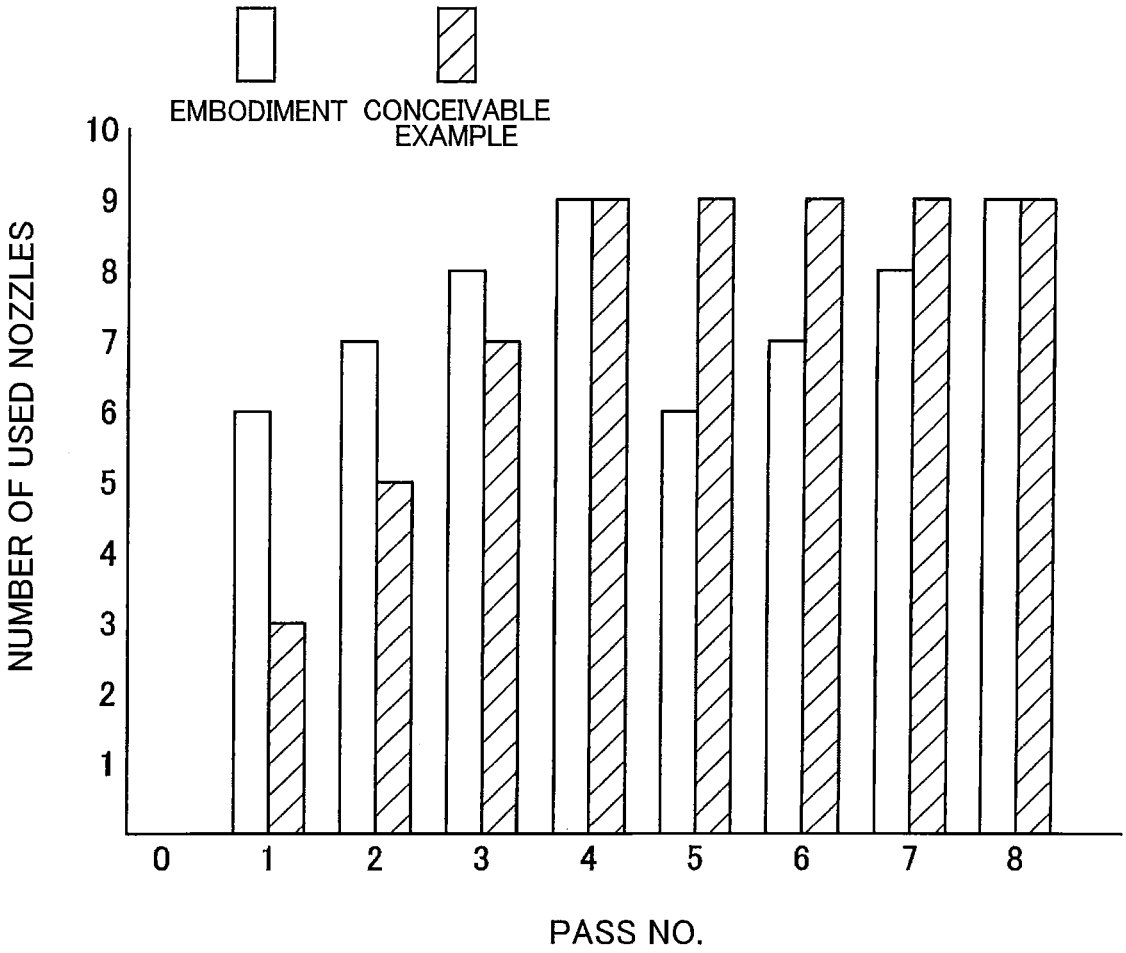
FIG. 9 is a graph showing a change in number of active nozzles that is used when printing the downstream edge of the recording medium according to the embodiment and the conceivable example.

As described above in the embodiment and illustrated in FIGS. 5 and 7, the control device 120 of the PC 100 can generate control data (see S18 of FIG. 4) for printing without forming white space on the upstream and downstream edges of the printing medium 90 and without depositing ink droplets on the protruding parts 74, even when conveyance error occurred when conveying the printing medium 90, within an allowable margin of ±three dot pitches from an ideal conveyance. By not depositing ink droplets on the top surfaces of the protruding parts 74, the printing medium 90 will not be soiled by such deposited ink droplets. Moreover, as illustrated in FIG. 5, the control device 120 generates control data such that the first special nozzles does not form dots during the $1^{st}$ through $3^{rd}$ passes, regardless of whether the first special nozzles can form dots at the positions X1-X3. Further, the control device 120 generates control data for controlling the second special nozzles to form dots at the positions X1-X3 in the $5^{th}$ through $7^{th}$ passes. As a result, the number of nozzles used for ejecting ink droplets can be gently increased in the $1^{st}$ through $4^{th}$ passes (an increase of two nozzles at a time), after which the number of active nozzles remains constant from the $4^{th}$ pass on, as illustrated in FIG. 9.

Figure 6:
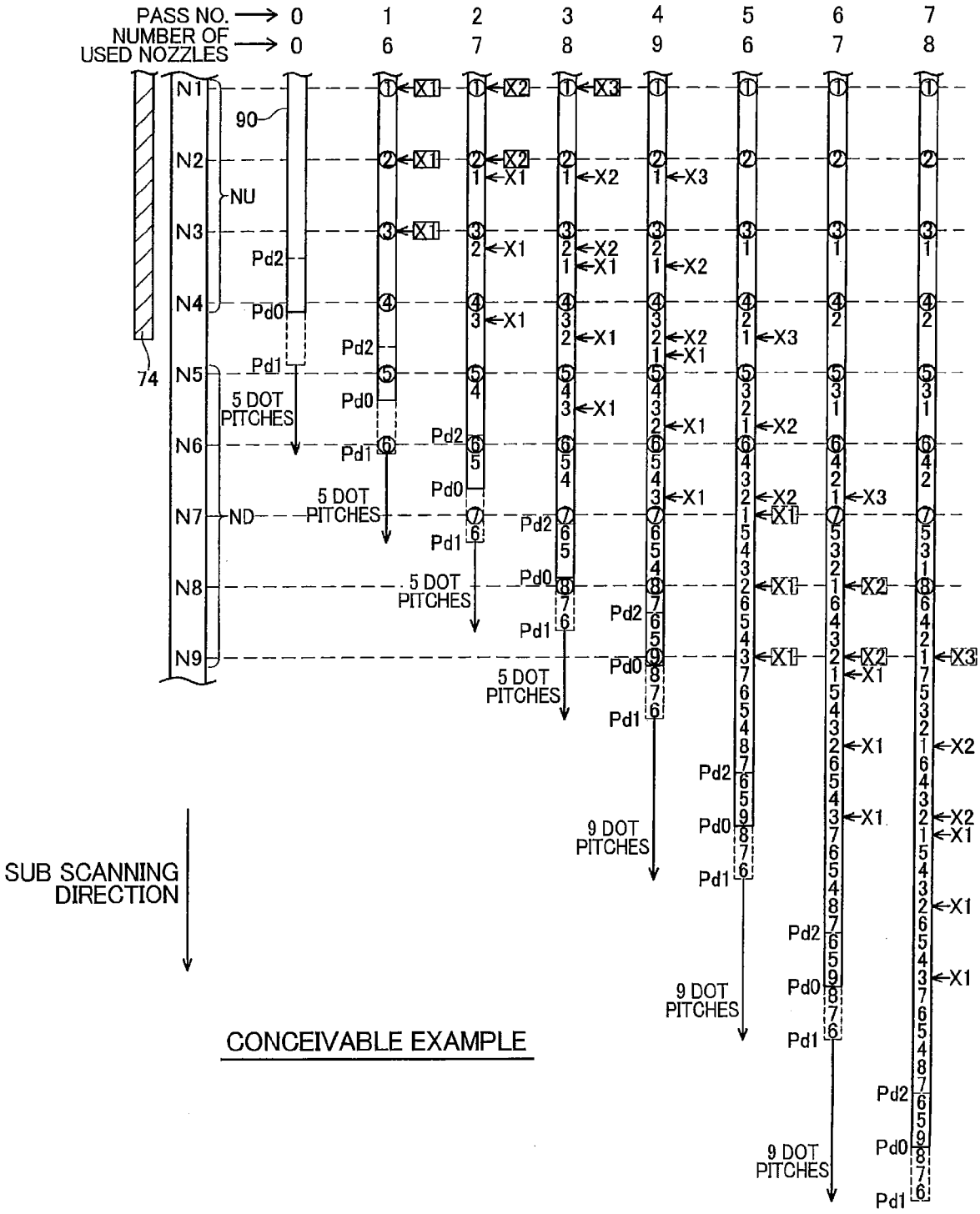
FIG. 6 is an explanation diagram illustrating how a downstream edge of a recording medium is printed according to a conceivable example.

FIG. 6 illustrates a conceivable example of a printing operation that applies a technique for forming dots at positions X1-X3 during the $1^{st}$ through $3^{rd}$ passes. In the conceivable printing example shown in FIG. 6, the number of nozzles used for ejecting ink droplets is gently increased through the $1^{St}$ through $4^{th}$ passes (an increase of one nozzle at a time). However, when forming dots at positions X1 in the $1^{st}$ pass, for example, the positions of the nozzles N7-N9 in the sub scanning direction are aligned with these positions X1 on the printing medium 90 in the $5^{th}$ pass, and thus the nozzles N7-N9 cannot eject ink droplets in the $5^{th}$ pass. Consequently, only six nozzles are used in the $5^{th}$ pass. Since nine nozzles were used in the $4^{th}$ pass in this example, the difference in active nozzles between the $4^{th}$ and $5^{th}$ passes is "3". As illustrated in FIG. 9, the maximum change in the number of active nozzles between two consecutive passes in the $1^{st}$ through $8^{th}$ passes is "2" in the embodiment, but "3" (between the $4^{th}$ and $5^{th}$ passes) in the conceivable example. Furthermore, while the number of nozzles used in the conceivable example increases during the $1^{st}$ through $4^{th}$ passes, this number decreases in the $5^{th}$ pass, resulting in a reversal from an increasing trend to a decreasing trend.

Moreover, the ejection characteristics of ink droplets change when the number of active nozzles changes. Normally, when there is an increase in the number of nozzles ejecting ink droplets, the size of the ejected ink droplets decreases, while a decrease in the number of nozzles ejecting ink droplets tends to increase the size of the ejected ink droplets. The cause of this phenomenon can be inferred as follows. As shown in FIG. 2, the piezoelectric layers constituting the laminate 35 of the actuator unit 34 are disposed so as to pass over all nozzles N1-N9 in the embodiment. With this configuration, a force working to deform the portion of the piezoelectric layers opposite an individual electrode that has been driven (the portion of the piezoelectric layers opposite the individual electrode I1, for example) acts as a pulling force on the surrounding portion of the piezoelectric layers (the portion opposing the individual electrode I2, for example). Therefore, when the number of nozzles used to eject ink droplets increases, a larger number of areas in the piezoelectric layers opposite a larger number of individual electrodes end up pulling against each other, reducing the amount of deformation in these portions of the piezoelectric layers. Consequently, the size of the ink droplets ejected from the corresponding nozzles is smaller. Therefore, an increase in the number of active nozzles produces a decrease in the quantity of ejected ink. This change in the ejection characteristics of ink droplets that accompanies a change in the number of active nozzles and is inherently caused by the structure of the actuator unit 34 is called "structural cross-talk." Further, the print head 30 employs a common ink channel that is in communication with all pressure chambers C1-C9, for example. The common ink channel is used to supply ink to the pressure chambers C1-C9 from an ink cartridge (not shown), for example. With this configuration, pressure waves generated by changes in pressure within the pressure chambers migrate to the common ink channel and interfere with each other, resulting in a decrease in the size of the ejected ink droplets as the number of active nozzles increases. This phenomenon is called "fluidic cross-talk."

Normally, clusters of dots that are adjacent to each other in the sub scanning direction are formed in two consecutive passes. For example, the nozzle N1 forms a first dot cluster (i.e., first raster) in the $4^{th}$ pass shown in FIGS. 5 and 6, and the nozzle N3 forms a second dot cluster (i.e., second raster) adjacent to the first cluster in the $5^{th}$ pass shown in FIGS. 5 and 6. In the conceivable example of FIG. 6, the size of the ink droplets ejected by the nozzle N1 in the $4^{th}$ pass is considerably different from the size of the ink droplets ejected from the nozzle N3 in the $5^{th}$ pass because the change in the number of nozzles used for ejection between the $4^{th}$ and $5^{th}$ passes is great (a change of three nozzles). Hence, in the printed image, the density of the first raster will be greatly different from the density of the second raster adjacent to the first raster, producing noticeable density irregularities in the printed image and resulting in lower image quality. In the embodiment, the maximum change in the number of nozzles used for ejection between any two consecutive passes (a change of two nozzles) is less than that in the conceivable example of FIG. 6. Accordingly, a printer employing the method described in the embodiment will produce images with less noticeable density irregularities than those in the conceivable example of FIG. 6 and, hence, can print images of higher quality.

As described above, a reversal in the increasing/decreasing trend of the number of active nozzles occurs in the conceivable example of FIG. 6. That is, the density of the dot clusters formed in the $1^{st}$ through $4^{th}$ passes gradually decreases since the number of active nozzles in the $1^{st}$ through $4^{th}$ passes of the conceivable example increases. However, as the density is gradually decreasing in this way, the size of ink droplets abruptly increases in the $5^{th}$ pass, resulting in an easily detectable change in density between the dot clusters formed in the $1^{st}$ through $4^{th}$ passes and the dot cluster formed in the $5^{th}$ pass. In other words, the irregularity in density at this time will be easily noticeable to the user. However, since this abrupt reversal in the number of active nozzles does not occur throughout the $0^{th}$ through $8^{th}$ passes of the embodiment, the printer 10 according to the embodiment can produce images of high quality without noticeable irregularities in density.

Figure 10:
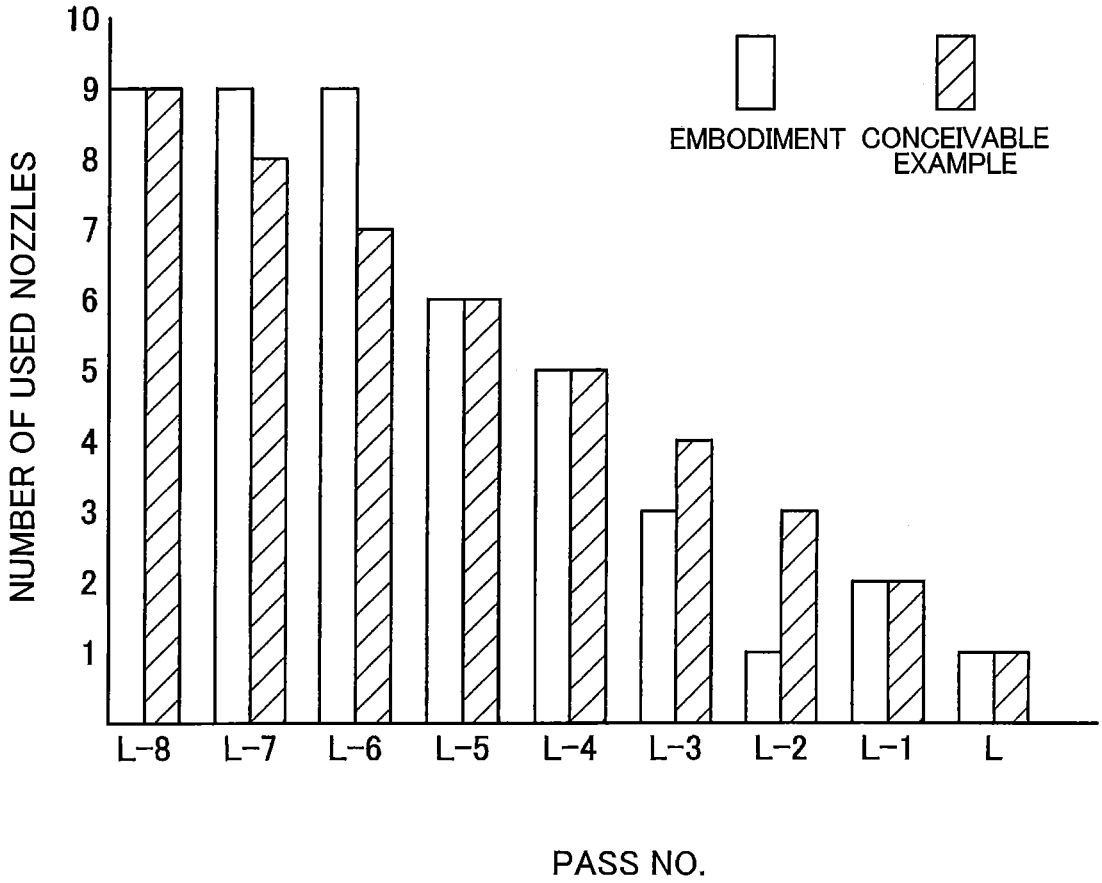
FIG. 10 is a graph showing a change in number of active nozzles that is used when printing the upstream edge of the recording medium according to the embodiment and the conceivable example.

Further, the control device 120 of the PC 100 generates control data such that the third special nozzles does not form dots at positions Y1 and Y2 in the $(L-7)^{th}$ and $(L-6)^{th}$ passes, as shown in FIG. 7, regardless of whether the third special nozzles are capable of forming dots at these positions. The control device 120 also generates control data for controlling the fourth special nozzles to form dots at these positions Y1 and Y2 in the $(L-3)^{th}$ and $(L-2)^{th}$ passes. As a result, the number of active nozzles is gradually reduced (a reduction of one nozzle at a time) between the $(L-8)^{th}$ and $L^{th}$ passes, as shown in FIG. 10.

Figure 8:
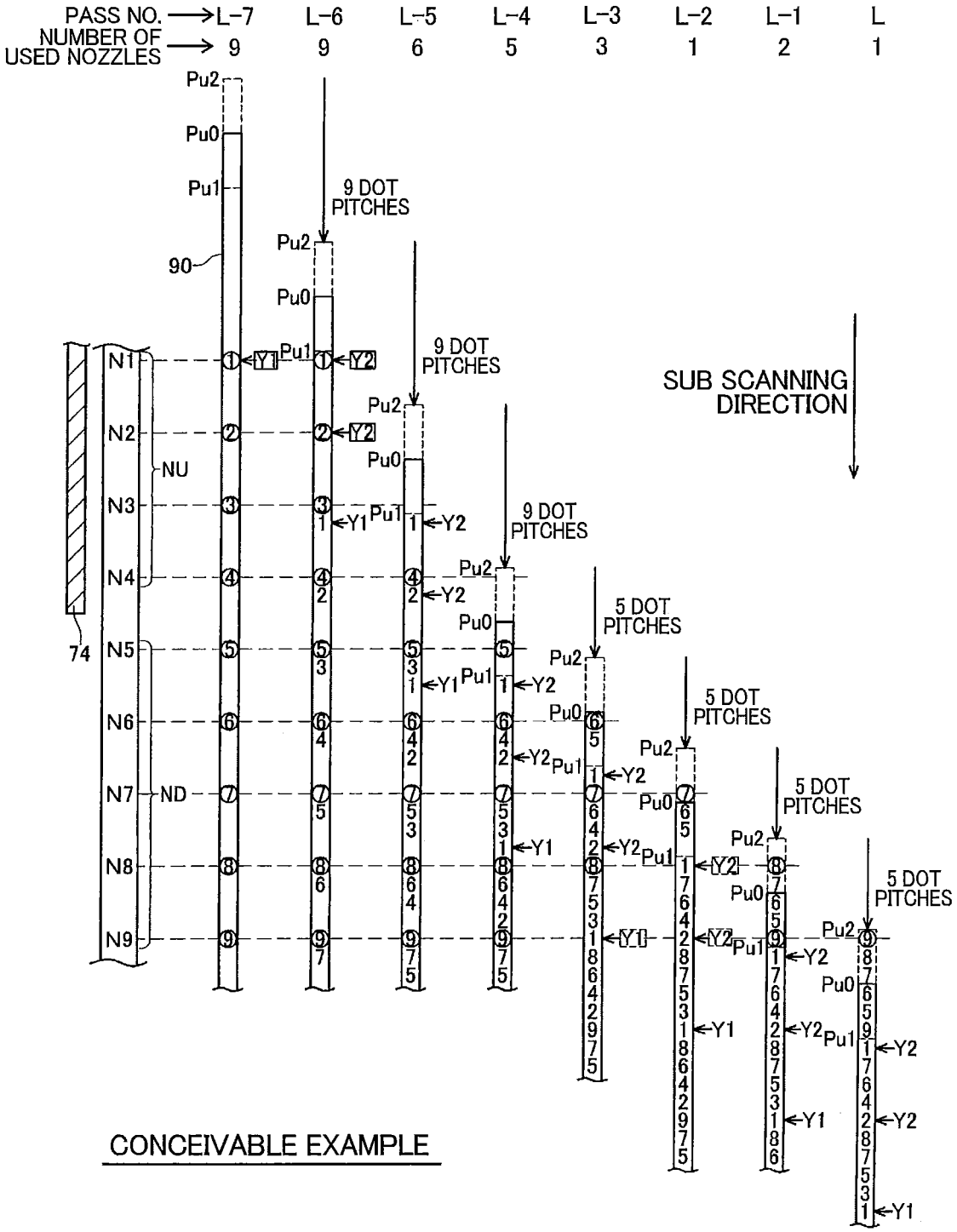
FIG. 8 is an explanation diagram illustrating how an upstream edge of a recording medium is printed according to the conceivable example.

The conceivable example in FIG. 8 illustrates a printing operation employing a technique for forming dots at positions Y1 and Y2 in the $(L-7)^{th}$ and $(L-6)^{th}$ passes. As shown in FIG. 8, when dots are formed at positions Y1 and Y2 in the $(L-7)^{th}$ and $(L-6)^{th}$ passes, the positions of the nozzles N8 and N9 become aligned with the positions Y1 and Y2 in the sub scanning direction during the $(L-3)^{th}$ and $(L-2)^{th}$ passes. Hence, the nozzles N8 and N9 cannot eject ink droplets during these passes. As can be seen in FIG. 10, the maximum change in the number of active nozzles between any two consecutive passes in the embodiment is "1" throughout the $(L-8)^{th}$ through $L^{th}$ passes. However, the maximum change in active nozzles between consecutive passes in the conceivable example is "3" (between the $(L-6)^{th}$ and $(L-5)^{th}$ passes). Since the maximum change in the number of active nozzles in the embodiment (i.e., "1") is less than that in the conceivable example of FIG. 8, the printer 10 of the embodiment can print images with less noticeable density irregularities and, thus, higher image quality than a printer employing the method of the conceivable example. Moreover, a reversing trend in the number of active nozzles from a decrease to an increase occurs in the conceivable example between the $(L-2)^{th}$ and $(L-1)^{th}$ passes. Since a reversal in the number of active nozzles does not occur in the embodiment between the $(L-8)^{th}$ and $L^{th}$ passes, the printer 10 according to the embodiment can form images with less noticeable density irregularities and higher image quality.

While the invention has been described in detail with reference to the embodiment thereof, it would be apparent to those skilled in the art that various changes and modifications may be made therein without departing from the spirit of the invention. For example, the following are variations of the embodiment described above.

(1) In the embodiment, the control device 120 of the PC 100 includes the generating unit 122 and the supply unit 124 for implementing the process in FIG. 4. However, the generating unit 122 and the supply unit 124 may be incorporated in the printer 10 instead. In this case, the generating unit 122 generates control data based on the RGB image data, and the supply unit 124 supplies the control data generated by the generating unit 122 to the controller 80 of the printing unit 20.

(2) In the embodiment described above, the conveying distance of the printing medium 90 is fixed (at five dot pitches) while printing the downstream end image DEI (refer to the conveying distances indicated in areas of FIG. 5 corresponding to the $0^{th}$ through $3^{rd}$ passes). But, the conveying distance of the printing medium 90 may be varied while printing the downstream end image DEI. For example, the conveying distance in the $1^{st}$ pass of FIG. 5 may be set to Q dot pitches (where Q is an integer of 1 or greater), and the conveying distance in the $2^{nd}$ pass may be set to R dot pitches (where R is an integer of 1 or greater that differs from Q).

More generally, the conveying distances may be varied while printing the downstream end image DEI, the upstream end image UEI, and the center image CI. In this case, the average values of the conveying distances while printing the center image CI may be greater than the average values of the conveying distances while printing the downstream end image DEI. Further, the average values of the conveying distances while printing the center image CI may be greater than the average values of the conveying distances while printing the upstream end image UEI.

Alternatively, some of the conveying distances while printing the downstream end image DEI, the upstream end image UEI, and the center image CI may be varied and the remaining conveying distances may be fixed. In this case, the average values of the conveying distances while printing the center image CI may be greater than the average values of the conveying distances while printing the downstream end image DEI. Further, the average values of the conveying distances while printing the center image CI may be greater than the average values of the conveying distances while printing the upstream end image UEI.

(3) In the embodiment described above, the upstream ends of the protruding parts 74 are positioned farther upstream than the nozzle N1, as shown in FIG. 2, where the nozzle N1 is positioned farthest upstream among the plurality of nozzles N1-N9. However, the protruding parts 74 may be configured such that their upstream ends are positioned farther downstream than the nozzle N1. For example, the upstream ends of the protruding parts 74 may be positioned between the nozzles N1 and N2. Further, the protruding parts 74 need not be formed continuously in the sub scanning direction, but each protruding part may be configured of separate components, such as a first protruding part opposing the nozzles N1 and N2 and a second protruding part opposing the nozzles N3 and N4 while the print head 30 reciprocates in a main scan.

(4) In the embodiment described above, three first special nozzles (N1-N3) are used in the $1^{st}$ pass, two first special nozzles (N1 and N2) in the $2^{nd}$ pass, and one first special nozzle (N1) in the $3^{rd}$ pass, as shown in FIG. 5. However, the number of first special nozzles used in each pass may be modified as needed. For example, it is possible to use just one first special nozzle (N1, for example) in the $1^{st}$ possible, or to employ no first special nozzles in any of the $1^{st}$ through $3^{rd}$ passes. Generally speaking, it is sufficient to employ at least one first special nozzle in at least one pass, and similarly to employ at least one second special nozzle in at least one pass. The same configuration may be applied to the $3^{rd}$ and fourth special nozzles.

(5) While four-pass interlace printing is employed in the embodiment described above, the invention may be applied to interlace printing with two or more passes. Alternatively, a printing method other than interlace printing may be employed, such as a method of forming a single raster within one nozzle pitch. Further, while one raster is formed by ejecting ink droplets from a single nozzle in the embodiment, a raster may be formed by ejecting ink droplets from two or more nozzles instead, as in a singling (overlapping) printing method.

(6) In addition to a printing device that performs printing operations using ink droplets, the techniques disclosed in the embodiment can be applied to a patterning device or the like for forming patterns on substrates, for example.

What is claimed is:

1. A control device for controlling a printing execution unit, wherein the printing execution unit includes:

a sheet conveying portion that is configured to convey a recording sheet from upstream side to downstream side in a first direction, the recording sheet including a downstream end region in the first direction and a center region in the first direction;

a print head having a plurality of nozzles arranged in the first direction, the plurality of nozzles including an upstream nozzle group disposed at the upstream side in the first direction and a downstream nozzle group disposed at the downstream side in the first direction, the plurality of nozzles including a first nozzle classified into the upstream nozzle group and a second nozzle classified into the downstream nozzle;

a head conveying portion that is configured to convey the print head in a second direction;

a head drive portion that is configured to drive the print head to eject ink droplets from the plurality of nozzles;

a sheet support portion that includes a contact part contacting and supporting the recording sheet, wherein when the head conveying portion conveys the print head in the second direction, the upstream nozzle group confronts the contact part and the downstream nozzle group does not confront the contact part; and a controlling portion that is configured to control the head conveying portion, the head drive portion, and the sheet conveying portion to execute a printing operation, the control device comprising;

a generating portion that generates control data that is to be used by the controlling portion to form a specific image expressed by image data on the recording sheet in the printing operation, the specific image including an end image located on an end portion of the specific image and a center image located on a center portion of the specific image; and a supplying portion that supplies the control data to the controlling portion, wherein the generating portion generates the control data such that in a first case of the printing operation where the printing execution unit forms the end image on the downstream end region of the recording sheet, the sheet conveying portion conveys the recording sheet by a first conveying distance in the first direction and the head drive portion drives the print head to eject ink droplet only from nozzles classified into the downstream nozzle group toward the downstream end region, wherein the generating portion generates the control data such that in a second case of the printing operation where the printing execution unit forms the center image on the center region of the recording sheet, the sheet conveying portion conveys the recording sheet by a second conveying distance greater than the first conveying distance in the first direction and the head drive portion drives the print head to eject ink droplet from the plurality of nozzles including the upstream nozzle group and the downstream nozzle group toward the center region, wherein the generating portion generates the control data such that, in the first case, the first nozzle classified into the upstream nozzle group does not eject ink droplet toward the center region for forming a specific part in the center portion of the specific image, regardless of whether the first nozzle is capable of ejecting ink droplet toward the center region for forming the specific part, and such that in the second case, the second nozzle classified into the downstream nozzle group ejects ink droplet for forming the specific part that has not been formed by the first nozzle.

2. The control device according to claim 1, wherein the second nozzle includes a nozzle located downstream endmost in the first direction among the plurality of nozzles.

3. The control device according to claim 1, wherein the generating portion generates the control data such that in the second case, the end portion of the specific image is not formed on the downstream end region of the recording sheet.

4. The control device according to claim 1, wherein the first nozzle includes a nozzle located at the upstream side in the first direction among the upstream nozzle group.

5. The control device according to claim 1, wherein a nozzle lastly ejecting ink droplet for forming the end image in the first case includes a nozzle that is located on downstream endmost among the downstream nozzle group.

6. A control device for controlling a printing execution unit, wherein the printing execution unit includes:

a sheet conveying portion that is configured to convey a recording sheet from upstream side to downstream side in a first direction, the recording sheet including an upstream end region in the first direction and a center region in the first direction;

a print head having a plurality of nozzles arranged in the first direction, the plurality of nozzles including an upstream nozzle group disposed at the upstream side in the first direction and a downstream nozzle disposed at the downstream side in the first direction, the plurality of nozzles including a first nozzle classified into the upstream nozzle group and a second nozzle classified into the downstream nozzle group;

a head conveying portion that is configured to convey the print head in a second direction;

a head drive portion that is configured to drive the print head to eject ink droplets from the plurality of nozzles;

a sheet support portion that includes a contact part contacting and supporting the recording sheet, wherein when the head conveying portion conveys the print head in the second direction, the upstream nozzle group confronts the contact part and the downstream nozzle group does not confront the contact part; and a controlling portion that is configured to control the head conveying portion, the head drive portion, and the sheet conveying portion to execute a printing operation, the control device comprising;

a generating portion that generates control data that is to be used by the controlling portion to form a specific image expressed by image data on the recording sheet in the printing operation, the specific image including an end image located on an end portion of the specific image and a center image located on a center portion of the specific image; and a supplying portion that supplies the control data to the controlling portion, wherein the generating portion generates the control data such that in a third case of the printing operation where the printing execution unit forms the center image on the center region of the recording sheet, the sheet conveying portion conveys the recording sheet by a third conveying distance in the first direction and the head drive portion drives the print head to eject ink droplet from the plurality of nozzles including the upstream nozzle group and the downstream nozzle group toward the center region, wherein the generating portion generates the control data such that in a fourth case of the printing operation where the printing execution unit forms the end image on the upstream end region of the recording sheet, the sheet conveying portion conveys the recording sheet by a fourth conveying distance shorter than the third conveying distance in the first direction and the head drive portion drives the print head to eject ink droplet only from nozzles classified into the downstream nozzle group toward the upstream end region, wherein the generating portion generates the control data such that, in the third case, the first nozzle classified into the upstream nozzle group does not eject ink droplet toward the center region for forming a specific part in the center portion of the specific image, regardless of whether the first nozzle is capable of ejecting ink droplet toward the center region for forming the specific part, and such that in the fourth case, the second nozzle classified into the downstream nozzle group ejects ink droplet for forming the specific part that has not formed by the first nozzle.

7. The control device according to claim 6, wherein the generating portion generates the control data such that in the third case, the end portion of the specific image is not formed on the upstream end region of the recording sheet.

8. The control device according to claim 6, wherein a nozzle lastly ejecting ink droplet for forming the end image in the fourth case includes a nozzle that is located on downstream endmost among the downstream nozzle group.

9. A printer comprising:

a control device according to claim 1; and the printing execution unit.

10. A printer comprising:

the control device according to claim 6; and the printing execution unit.

11. A non-transitory computer readable storage medium storing a set of program instructions installed on and executed by a computer for controlling a printing execution unit, wherein the printing execution unit including:

a sheet conveying portion that is configured to convey a recording sheet from upstream side to downstream side in a first direction, the recording sheet including a downstream end region in the first direction and a center region in the first direction;

a print head having a plurality of nozzles arranged in the first direction, the plurality of nozzles including an upstream nozzle group disposed at the upstream side in the first direction and a downstream nozzle group disposed at the downstream side in the first direction, the plurality of nozzles including a first nozzle classified into the upstream nozzle group and a second nozzle classified into the downstream nozzle group;

a head conveying portion that is configured to convey the print head in a second direction;

a head drive portion that is configured to drive the print head to eject ink droplets from the plurality of nozzles;

a sheet support portion that includes a contact part contacting and supporting the recording sheet, wherein when the head conveying portion conveys the print head in the second direction, the upstream nozzle group confronts the contact part and the downstream nozzle group does not confront the contact part; and a controlling portion that is configured to control the head conveying portion, the head drive portion, and the sheet conveying portion to execute a printing operation; and the program instructions comprising:

generating control data that is to be used by the controlling portion to form a specific image expressed by image data on the recording sheet in the printing operation, the specific image including an end image located on an end portion of the specific image and a center image located on a center portion of the specific image; and supplying the control data to the controlling portion, wherein the generating generates the control data such that in a first case of the printing operation where the printing execution unit forms the end image on the downstream end region of the recording sheet, the sheet conveying portion conveys the recording sheet by a first conveying distance in the first direction and the head drive portion drives the print head to eject ink droplet only from nozzles classified into the downstream nozzle group toward the downstream end region, wherein the generating generates the control data such that in a second case of the printing operation where the printing execution unit forms the center image on the center region of the recording sheet, the sheet conveying portion conveys the recording sheet by a second conveying distance greater than the first conveying distance in the first direction and the head drive portion drives the print head to eject ink droplet from the plurality of nozzles including the upstream nozzle group and the downstream nozzle group toward the center region, wherein the generating generates the control data such that, in the first case, the first nozzle classified into the upstream nozzle group does not eject ink droplet toward the center region for forming a specific part in the center portion of the specific image, regardless of whether the first nozzle is capable of ejecting ink droplet toward the center region for forming the specific part, and such that in the second case, the second nozzle classified into the downstream nozzle group ejects ink droplet for forming the specific part that has not formed by the first nozzle.

12. A non-transitory computer readable storage medium storing a set of program instructions installed on and executed by a computer for controlling a printing execution unit, wherein the printing execution unit including:

a sheet conveying portion that is configured to convey a recording sheet from upstream side to downstream side in a first direction, the recording sheet including an upstream end region in the first direction and a center region in the first direction;

a print head having a plurality of nozzles arranged in the first direction, the plurality of nozzles including an upstream nozzle group disposed at the upstream side in the first direction and a downstream nozzle group disposed at the downstream side in the first direction, the plurality of nozzles including a first nozzle classified into the upstream nozzle group and a second nozzle classified into the downstream nozzle group;

a head conveying portion that is configured to convey the print head in a second direction;

a head drive portion that is configured to drive the print head to eject ink droplets from the plurality of nozzles;

a sheet support portion that includes a contact part contacting and supporting the recording sheet, wherein when the head conveying portion conveys the print head in the second direction, the upstream nozzle group confronts the contact part and the downstream nozzle group does not confront the contact part; and a controlling portion that is configured to control the head conveying portion, the head drive portion, and the sheet conveying portion to execute a printing operation, the program instructions comprising:

generating control data that is to be used by the controlling portion to form a specific image expressed by image data on the recording sheet in the printing operation, the specific image including an end image located on an end portion of the specific image and a center image located on a center portion of the specific image; and supplying the control data to the controlling portion, wherein the generating generates the control data such that in a third case of the printing operation where the printing execution unit forms the center image on the center region of the recording sheet, the sheet conveying portion conveys the recording sheet by a third conveying distance in the first direction and the head drive portion drives the print head to eject ink droplet from the plurality of nozzles including the upstream nozzle group and the downstream nozzle group toward the center region, wherein the generating generates the control data such that in a fourth case of the printing operation where the printing execution unit forms the end image on the upstream end region of the recording sheet, the sheet conveying portion conveys the recording sheet by a fourth conveying distance shorter than the third conveying distance in the first direction and the head drive portion drives the print head to eject ink droplet only from nozzles classified into the downstream nozzle group toward the upstream end region, wherein the generating generates the control data such that, in the third case, the first nozzle classified into the upstream nozzle group does not eject ink droplet toward the center region for forming a specific part in the center portion of the specific image, regardless of whether the first nozzle is capable of ejecting ink droplet toward the center region for forming the specific part, and such that in the fourth case, the second nozzle classified into the downstream nozzle group ejects ink droplet for forming the specific part that has not been formed by the first nozzle.

* * * * *